US005954482A

United States Patent [19]

Ijiri et al.

[11] Patent Number: 5,954,482

[45] Date of Patent: Sep. 21, 1999

[54] COMPRESSOR HAVING PRESSURE ELIMINATING MEANS

[75] Inventors: Makoto Ijiri; Tatsuhiro Tohyama, both of Narashino, Japan

[73] Assignee: Seiko Seiki Kabushiki Kaisha, Japan

[21] Appl. No.: 08/705,538

[22] Filed: Aug. 29, 1996

[51] Int. Cl.[6] ..... F04B 49/00

[52] U.S. Cl. ..... 417/310; 418/87; 184/6.17

[58] Field of Search ..... 417/310; 418/87, 418/98; 184/6.17

[56] References Cited

U.S. PATENT DOCUMENTS

| | | | |
|---|---|---|---|
| 2,235,251 | 3/1941 | Boldt . | |
| 3,243,103 | 3/1966 | Bellmer | 418/87 |
| 4,342,547 | 8/1982 | Yamada et al. | 418/87 |
| 4,407,641 | 10/1983 | Long . | |
| 5,199,855 | 4/1993 | Nakajima et al. | 417/295 |

FOREIGN PATENT DOCUMENTS

| | | | |
|---|---|---|---|
| 44530 | 1/1982 | European Pat. Off. . | |
| 1047535 | 12/1953 | France . | |
| 2218491 | 9/1974 | France . | |
| 2926076 | 2/1981 | Germany . | |
| 55-78190 | 6/1980 | Japan | 418/87 |
| 1437318 | 5/1976 | United Kingdom . | |

OTHER PUBLICATIONS

Patent Abstracts of Japan, vol. 9, No. 38 (M–358) [1761] Feb. 19, 1985.

*Primary Examiner*—Timothy S. Thorpe
*Assistant Examiner*—Cheryl J. Tyler
*Attorney, Agent, or Firm*—Adams & Wilks

[57] ABSTRACT

A gas compressor has a first chamber for receiving a low pressure refrigerant gas. A main body has a second chamber for drawing in the low pressure refrigerant gas from the first chamber and undergoing a compression operation to compress the low pressure refrigerant gas into a high pressure refrigerant gas. A third chamber receives the high pressure refrigerant gas from the second chamber. A fourth chamber receives a lubricating oil and is subjected to the pressure of the high pressure refrigerant gas from the third chamber. An oil passage has an inlet port opening into the fourth chamber and an outlet port opening into the main body. The lubricating oil from the fourth chamber is supplied to the main body through the oil passage due to a pressure difference between the third chamber and one of the first chamber and the second chamber. A pressure difference eliminating device releases the high pressure refrigerant gas from the third chamber to the first chamber upon stoppage of the compression operation in the second chamber to thereby eliminate the pressure difference between the third chamber and one of the first chamber and the second chamber.

18 Claims, 16 Drawing Sheets

COMPRESSOR HAVING PRESSURE ELIMINATING MEANS

BACKGROUND OF THE INVENTION

The present invention relates to a gas compressor which is used in, for example, a car air-conditioner. More particularly, the invention relates to a gas compressor which is adapted to prevent the occurrence of inconveniences due to oil compression at a time of restarting the operation of the gas compressor, such as an increase in the starting torque.

In a conventional gas compressor, as illustrated in FIG. 18, an open end of a casing 1 is closed by a front head 2 and a main body 3 is disposed within the casing 1. The main body 3 of the compressor has between a front-side block 4 and a rear-side block 5 a cylinder 6 whose inner periphery is substantially elliptical. A rotor 8 is rotatably disposed laterally within a cylinder chamber 7 defined by the blocks 4, 5 and the cylinder 6. The rotor 8 has integrally formed thereon a rotor shaft 8*a* which passes through end faces of the rotor. The rotor shaft 8*a* is supported by an F bearing 4*a* of the front-side block 4 and by an R bearing 5*a* of the rear-side block 5.

As illustrated in FIG. 19, the rotor 8 has formed therein slit-like vanes grooves 9 in its radial direction. Vanes 10 are mounted in the vane grooves 9 in such a way as to freely advance and retreat. When the rotor 8 rotates, the vanes 10 are urged against the inner wall side of the cylinder 6 by the centrifugal force and the oil pressure at the bottom of the vane grooves.

Small space portions within the cylinder chamber 7 each of which is defined by the front and rear side blocks 4, 5, cylinder 6, rotor 8 and vanes 10 are called "compression chamber space portions 11", each compression chamber space portion having its volume repeatedly varied by the rotation of the rotor 8.

In the above-mentioned main body 3 of the compressor, when the rotor 8 rotates with the result that the volume of each compression space portion 11 varies, the compression chamber space portion sucks a low pressure refrigerant gas from a suction chamber 12 and compresses it due to the variations in the volume.

The high pressure refrigerant gas after having been compressed is discharged into a discharge chamber 16 through discharge ports 13, discharge valves 14, a discharge communication passage 19, an oil separator 15, etc. At this time, the oil separator 15 separates oil from the high pressure refrigerant gas, the thus separated oil being pooled at the bottom of the discharge chamber 16, thereby forming an oil pool 17 in which lubricating oil is pooled.

The lubricating oil in the oil pool 17 is pressure supplied to sliding portions such as the F bearing 4*a* and the R bearing 5*a* through an oil passage 18. This pressure supply of the lubricating oil is effected by the high/low pressure difference between the suction chamber 12 or compression chamber 11 and the discharge chamber 16, i.e., the low pressure portion and the high pressure portion.

The lubricating oil that has been supplied to the sliding portions flows finally into the suction chamber 12 that constitutes the low pressure portion and thereafter becomes mist in the low pressure refrigerant gas of the suction chamber 12 and is sucked into the main body 3 of the compressor, wherein the thus sucked oil mist is again compressed together with the refrigerant gas.

However, in the above-mentioned conventional gas compressor, since the forced supply of the lubricating oil to the sliding portions is effected by the high/low pressure difference between the low pressure portion (suction chamber 12 or compression chamber 11) and the high pressure portion (discharge chamber 16), even when the compression operation is stopped, the flow of the lubricating oil from the oil pool 17 to the suction chamber 12 and compression chamber 11 through the oil passage 18 and sliding portions (F bearing 4*a*, R bearing 5*a*, etc.) is not stopped so long as the high/low pressure difference exists. Particularly, since after the stoppage of the compression operation no execution is made of the compression/discharge processes, the lubricating oil which has once flown into the compression chamber 11 is not compressed as mist and does not return to the discharge chamber 11 side, with the result that during the stoppage of the compression operation the lubricating oil pools in the suction chamber 12 and compression chamber 11 in large amounts.

When the lubricating oil is pooled in the compression chamber 11 as mentioned above, restarting of the compression operation is accompanied by a so-called "oil compression" wherein the lubricating oil is not compressed as a mist but is compressed as it is in a liquid state, with the result that the starting torque increases and the shock at the starting time of the compression operation also increases.

Furthermore, when the lubricating oil pools in the suction chamber 12, restarting of the compression operation causes the lubricating oil to be sucked into the main body 3 of the compressor not as a mist but in a liquid oil state and compressed. Therefore, in this case also, the oil compression occurs at the time of restarting the compression operation, with the result that the starting torque and the shock at the starting time both increase.

SUMMARY OF THE INVENTION

The present invention overcomes the drawbacks of the conventional art by providing a gas compressor which prevents the occurrence of inconveniences resulting from the oil compression at a time of restarting the operation of the compressor, such as an increase in the starting torque.

In order to attain the above and other objects, according to a first embodiment of the present invention, a gas compressor comprises a suction chamber having a low pressure refrigerant gas introduced thereinto, a main body equipped with a compression chamber for sucking the low pressure refrigerant gas of the suction chamber and compressing it, a discharge chamber into which a high pressure refrigerant gas after having been compressed is discharged from the main body of the compressor, an oil pool on which the pressure of the discharge chamber acts, and an oil passage having an inflow opening open to the oil pool and an outflow opening open to sliding portions of the main body of the compressor, whereby a lubricating oil is supplied due to a high/low pressure difference between the suction chamber or compression chamber and the discharge chamber from the oil pool to the sliding portions of the main body of the compressor through the oil passage. The oil passage is provided with oil passage opening/closing means for opening the oil passage in interlocking relationship with a compression starting operation of the main body of the compressor and for closing the oil passage in interlocking relationship with a compression stopping operation thereof.

In a second embodiment of the present invention, a gas compressor comprises a suction chamber having a low pressure refrigerant gas introduced thereinto, a main body equipped with a compression chamber for sucking the low pressure refrigerant gas of the suction chamber and compressing it, a discharge chamber into which a high pressure refrigerant gas after having been compressed is discharged from the main body of the compressor, an oil pool on which the pressure of the discharge chamber acts, and an oil passage having an inflow opening open to the oil pool and an outflow opening open to sliding portions of the main body of the compressor, whereby a lubricating oil is supplied due to a high/low pressure difference between the suction chamber or compression chamber and the discharge chamber from the oil pool to the sliding portions of the main body of the compressor through the oil passage. The gas compressor is provided with pressure difference eliminating means which, when the compression operation of the main body of the compressor is stopped, releases the high pressure refrigerant gas of the discharge chamber to the suction chamber side to thereby eliminate a high/low pressure difference between the suction chamber or compression chamber and the discharge chamber.

In a third embodiment of the present invention, a gas compressor comprises a suction chamber having a low pressure refrigerant gas introduced thereinto, a main body equipped with a compression chamber for sucking the low pressure refrigerant gas of the suction chamber and compressing it, a discharge chamber into which a high pressure refrigerant gas after having been compressed is discharged from the main body of the compressor, an oil pool on which the pressure of the discharge chamber acts, and an oil passage having an inflow opening open to the oil pool and an outflow opening open to sliding portions of the main body of the compressor, whereby a lubricating oil is supplied due to a high/low pressure difference between the suction chamber or compression chamber and the discharge chamber from the oil pool to the sliding portions of the main body of the compressor through the oil passage. The gas compressor is equipped with oil passage opening/closing means provided in the oil passage for opening in interlocking relationship with a compression starting operation of the main body of the compressor and for closing the oil passage in interlocking relationship with a compression stopping operation thereof, and pressure difference eliminating means which, when the compression operation of the main body of the compressor is stopped, releases the high pressure refrigerant gas of the discharge chamber to the suction chamber side to thereby eliminate a high/low pressure difference between the suction chamber or compression chamber and the discharge chamber.

In a fourth embodiment of the present invention, the oil passage opening/closing means comprises a valve chest provided midway in the oil passage and an oil passage opening/closing valve element that is slidably disposed within the valve chest and that. After the start of the compression operation of the main body of the compressor, the oil passage opening/closing valve element is slid by a discharged jet flow of the high pressure refrigerant gas from the main body of the compressor to thereby open the oil passage. After the stoppage of the compression operation, the oil passage opening/closing valve element is slid by an urging force of urging means composed of a spring or the like to thereby close the oil passage.

In a fifth embodiment of the present invention, the gas compressor further comprises an electromagnetic clutch that transmits and interrupts a power needed for performance of the compression operation according to the ON and OFF operations thereof. The oil passage opening/closing means comprises an oil passage electromagnetic valve that opens and closes the oil passage according to the ON and OFF operations of the electromagnetic clutch.

In a sixth embodiment of the present invention, the pressure difference eliminating means comprises a communication passage that is opened at one end to the suction chamber and opened at the other end to the discharge chamber, a valve chest that is so provided as to intersect the communication passage, and a communication passage opening/closing valve element that is slidably disposed within the valve chest and that. After the start of the compression operation of the main body of the compressor, the communication passage opening/closing valve element is slid by a discharged jet flow of the high pressure refrigerant gas from the main body of the compressor to thereby close the communication passage. After the stoppage of the compression operation, the communication passage opening/closing valve element is slid by an urging force of urging means composed of a spring or the like to thereby open the communication passage.

In a seventh embodiment of the present invention, the gas compressor further comprises an electromagnetic clutch that transmits and interrupts a power needed for performance of the compression operation according to the ON and OFF operations thereof. The pressure difference eliminating means comprises a communication passage that is opened at one end to the suction chamber and opened at the other end to the discharge chamber, and a communication passage electromagnetic valve that opens and closes the communication passage according to the ON and OFF operations of the electromagnetic clutch.

In an eighth aspect of the present invention, the oil passage opening/closing means and the pressure difference eliminating means jointly comprises a communication passage that is opened at one end to the suction chamber and opened at the other end to the discharge chamber, a two-passage communication valve chest that is so provided as to intersect the communication passage and the oil passage, and a two-passage dual purpose valve element that is slidably disposed within the two-passage communication valve chest. After the start of the compression operation of the main body of the compressor, the two-passage dual purpose valve element is slid by a discharged jet flow of the high pressure refrigerant gas from the main body of the compressor to thereby open the oil passage and close the communication passage. After the stoppage of the compression operation, the two-passage dual purpose valve element is slid by an urging force of urging means composed of a spring or the like to thereby close the oil passage and open the communication passage.

In an ninth embodiment of the present invention, the gas compressor further comprises and electromagnetic clutch that transmits a power needed for performance of the compression operation to the main body side of the compressor according to the ON operation thereof and interrupts the transmission of this power according to the OFF operation thereof. The oil passage opening/closing means and the pressure difference eliminating means jointly comprises a communication passage that is opened at one end to the suction chamber and opened at the other end to the discharge chamber, and a two-passage dual purpose electromagnetic valve which, according to the ON operation of the electromagnetic clutch, opens the oil passage and closes the communication passage and which, according to the OFF operation thereof, closes the oil passage and opens the communication passage.

According to the above-constructed gas compressor of the present invention, when the compression operation in the main body of the compressor stops, the oil passage opening/closing means closes the oil passage interlockingly therewith. Accordingly, when the compression operation stops, even if there exists the residual high/low pressure difference between the suction compression chamber and the discharge chamber, the lubricating oil is not supplied due to the high/low pressure difference from the oil pool to the suction or compression chamber side through the oil passage and sliding portions. As a result, the flow of the lubricating oil into the suction or compression chamber during the stoppage of the compression operation is prevented.

Further, when the compression operation in the main body of the compressor stops, the high/low pressure difference between the suction chamber and the discharge chamber is eliminated by the pressure difference eliminating means, with the result that the flow of the lubricating oil into the suction chamber or compression chamber side due to such high/low pressure difference is stopped.

Furthermore, in the present invention, when the compression operation has stopped, the oil passage becomes closed interlockingly therewith. Simultaneously, at this time, the high pressure refrigerant gas that remains to exist in the discharge chamber is released into the suction chamber, whereby the high/low pressure difference between the discharge chamber and the suction or compression chamber is eliminated.

DETAILED DESCRIPTION OF THE PREFERRED EMBODIMENTS

Figure 1:
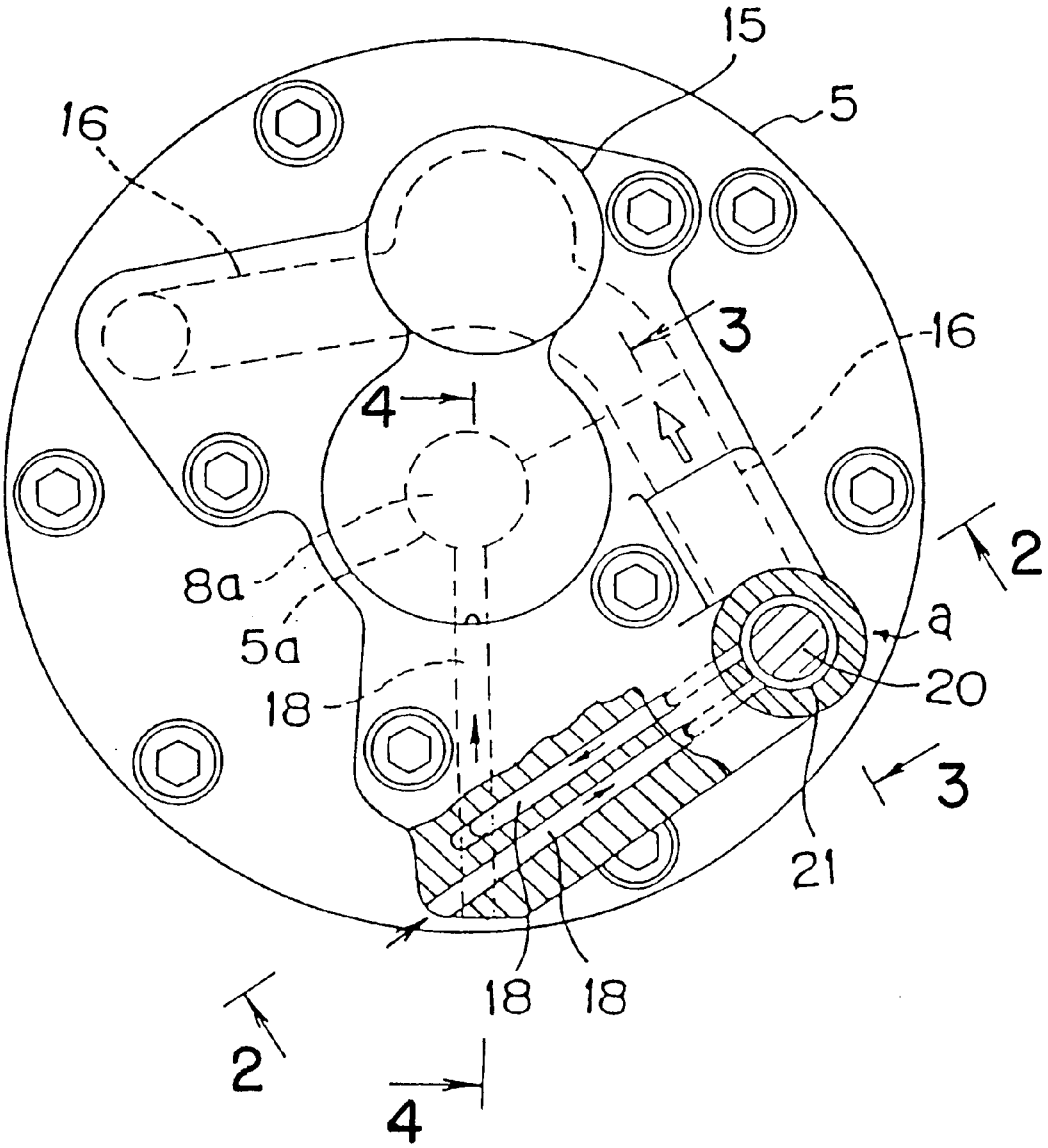
FIG. 1 is a view illustrating an embodiment of the present invention.

A gas compressor according to an embodiment of the present invention will now be explained in detail with reference to FIGS. 1 to 17.

It is to be noted that the following basic construction and operation of the gas compressor is the same as in the prior art: the main body 3 of the compressor; when the rotor 8 rotates the volume of the compression chamber space portions 11 varies; the suction of the low pressure refrigerant gas from the suction chamber 12 into the main body 3 of the compressor and the compression thereof within the main body 3 which are effected by the volume variation and, after compression, the high pressure refrigerant gas is discharged into the discharge chamber 16 through the discharge valves 14 and the oil separator 15; the oil separator 15 which separates the oil portion from the high pressure refrigerant gas and the thus separated oil portion pools at the bottom portion of the discharge chamber 16 whereupon the oil pool 17 is formed; the lubricating oil in the oil pool 17 which is forcedly supplied to the sliding portions such as the F bearing 4*a*, R bearing 5*a*, etc. through the oil passage 18, this forced supply being caused to occur due to the high/low pressure difference between the suction chamber 12 and the discharge chamber 16; etc. Therefore, the same components as in the prior art are denoted by the same reference numerals and detailed explanations thereof are omitted.

As illustrated in FIG. 1, the gas compressor according to the present invention has midway in the oil passage 18 an oil passage opening/closing valve element 20 that serves as oil passage opening/closing means (a) therefore. This valve element 20 is slidably disposed within a valve chest 21 that is provided midway in the oil passage 18. The valve chest 21 is so formed as to intersect the oil passage 18.

Figure 2:
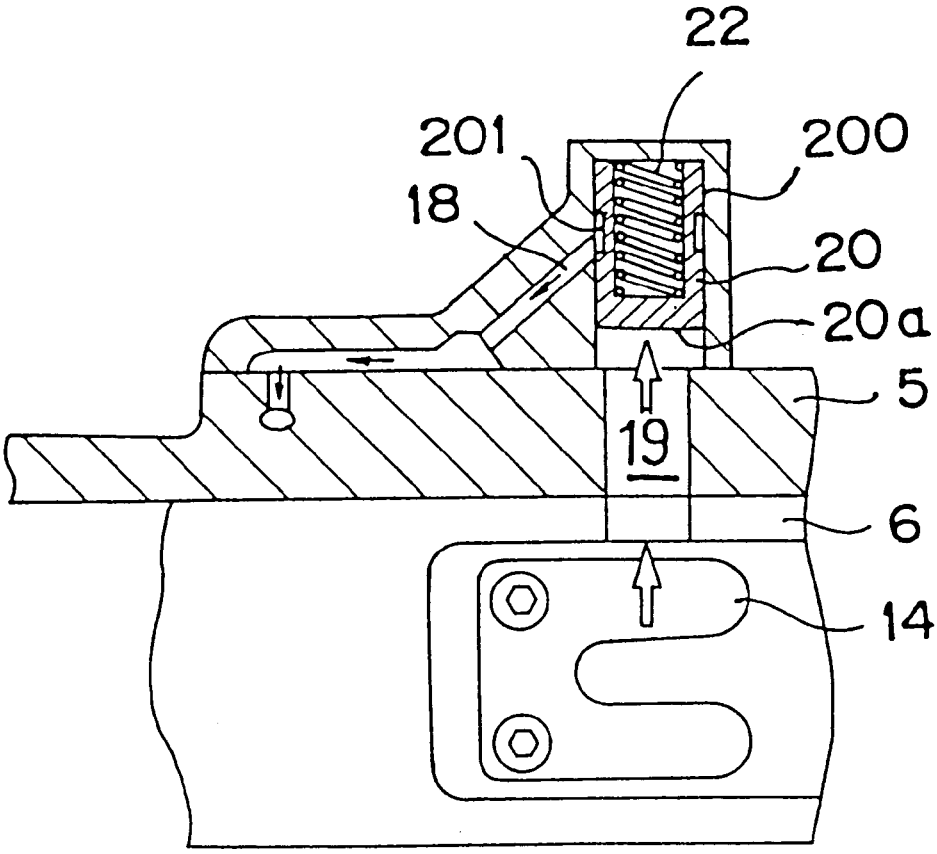
FIG. 2 is a sectional view taken along the line 2—2 of FIG. 1.
Figure 3:
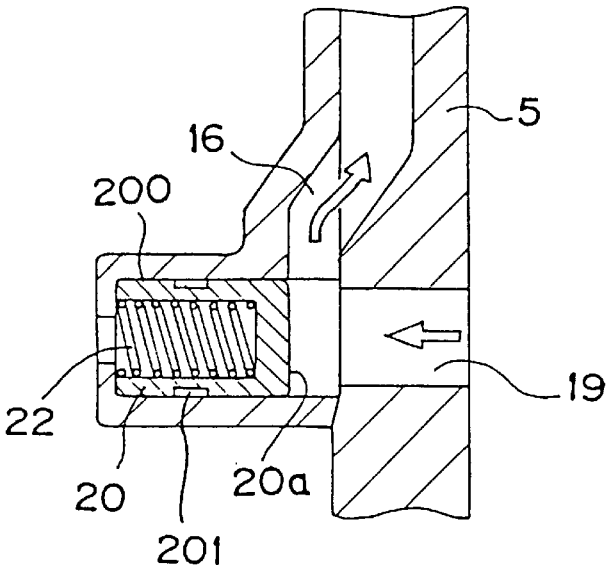
FIG. 3 is a sectional view taken along the line 3—3 of FIG. 1.

As illustrated in FIG. 2, a trunk portion 200 of the valve element 20 has a constricted portion 201 formed in a part thereof. When this valve element 20 is slid whereby this constricted portion 201 and the oil passage 18 positionally coincide and are in fluid communication with each other, the oil passage 18 is opened. On the other hand, when the constricted portion 201 gets of from this position of coincidence, the oil passage 18 is closed.

The oil passage opening/closing valve element 20 is built in near the discharge valve 14 on the rear-side block side 5.

An end fact (pressure receiving surface) 20*a* of the valve element 20 confronts an open end of a discharge communication passage for making communication between the discharge valve 14 and the discharge chamber 16 (refer to FIG. 3) and it is arranged for the high pressure refrigerant gas at a time immediately after having been discharged from the discharge valve 14 to act directly on this end face 20*a* as a discharged jet flow thereof. By the dynamic pressure of this discharged jet flow, the valve element 20 is urged toward a position where it opens the oil passage 18 (refer to FIG. 2).

Within the valve element 20 a spring 22 is disposed as urging means and by the force of this spring 22 the valve element 20 is urged toward a position where it closes the oil passage 18. Thus when the discharged jet flow acts on the end face 20*a* of the valve element 20, the valve element 20 is slid against the force of the spring 22 by the dynamic pressure thereof, whereupon the constricted portion 201 and the oil passage 18 positionally coincide with each other, with the result that the oil passage 18 is opened. Furthermore, when the discharged jet flow with respect to the end face 20*a* of the valve element is stopped, the valve element 20 is slid by the force of the spring 22, whereby the position of the constricted portion 201 gets off from the position of coincidence thereof with the oil passage 18. As a result, substantially simultaneously with the stoppage of the discharged jet flow, the oil passage 18 is closed.

When the main body 3 of the compressor starts to make its compression operation and the high pressure refrigerant gas having been compressed is discharged therefrom, the oil passage opening/closing valve element 20 is slid interlockingly with the compression starting operation and, during a time period from immediately after the start of the compression to the stoppage thereof, opens the oil passage 18. On the other hand, when the high pressure refrigerant gas ceases to flow out as a result of the stoppage of the compression operation, the oil passage opening/closing valve element 20 is slid interlockingly with the compression stopping operation and, during a time period from immediately after the stoppage of the compression operation to the start thereof, closes the oil passage 18.

Next, the operation of the above-constructed gas compressor will be explained with reference to FIGS. 1 to 4.

As noted above, when the operation of the gas compressor is started, the rotor 8 in the main body 3 of the compressor rotates and the volumes of the compression chamber portions 11 vary, whereupon the low pressure refrigerant gas of the suction chamber 12 is sucked and compressed due to the volume variations.

According to this gas compressor, when the operation is started, the high pressure refrigerant gas that has been compressed by the main body 3 of the compressor immediately thereafter acts directly on the end face 20*a* of the volume element 20 from the discharge valve 14. As a result, the valve element 20 is slid against the force of the spring 22, whereby the oil passage 18 is opened.

The high pressure refrigerant gas that has acted on the end face 20*a* of the valve element 20 is thereafter discharged into the discharge chamber 16 through the discharge communication passage 19, oil separator 15, etc. At this time, the oil separator 15 separates the oil portion from the high pressure refrigerant gas and the thus separated oil portion pools at the bottom of the discharge chamber 16, whereby the oil pool 17 for the lubricating oil if formed (refer to FIG. 17)

Figure 4:
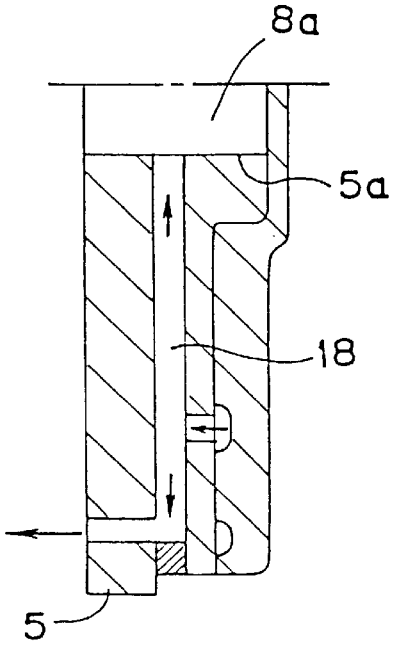
FIG. 4 is a sectional view taken along the line 4—4 of FIG. 1.

The lubricating oil in the oil pool 17 which has been pooled as mentioned above is forcedly supplied to the sliding portions such as the F bearing 4*a*, R bearing 5*a*, etc. through the oil passage 18 due to the high/low pressure difference between each of the suction chamber 12 and compression chamber 11 and the discharge chamber 16 (refer to FIG. 4)

When the operation of the gas compressor is stopped with the result that the rotation of the rotor 8 is stopped, the discharged jet flow of the high pressure refrigerant gas from the main body 3 of the compressor 3 to the end face 20*a* of the valve element 20 is stopped. At this time, the valve element 20 is slid by the force of the spring 22, with the result that the oil passage 18 is closed, whereby the forced supply of the lubricating oil that is made by way of the oil passage 18 is stopped.

The gas compressor of the above-mentioned embodiment is provided with the oil passage opening/closing valve element 20 that closes the oil passage 18 interlockingly with the compression stopping operation. For this reason, when the compression operation is stopped, during even a time period in which the high/low pressure difference remains to exist between each of the suction chamber 12 and compression chamber 11 and the discharge chamber 16 it does not happen that due to the high/low pressure difference the lubricating oil is supplied from the oil pool 17 to the suction chamber and compression chamber 11 side through the oil passage 18 and the sliding portions (F bearing 4*a*, R bearing 5*a*, etc.). That is, during the stoppage of the compression operation, it is possible to prevent the flow of the lubricating oil into the suction chamber 12 and compression chamber 11. Accordingly, when the compression operation has been restarted, the lubricating oil that is sucked from the suction chamber 12 to the main body 3 side of the compressor as it is in a liquid state as well as the lubricating oil within the compression chamber 11 is decreased to the largest possible extent. Accordingly, the oil compression in the main body 3 of the compressor when starting the compressor ceases to occur, with the result that it is possible to restart the compression operation with a small starting torque, decrease the shock at the starting time that results from the oil compression, etc.

Figure 5:
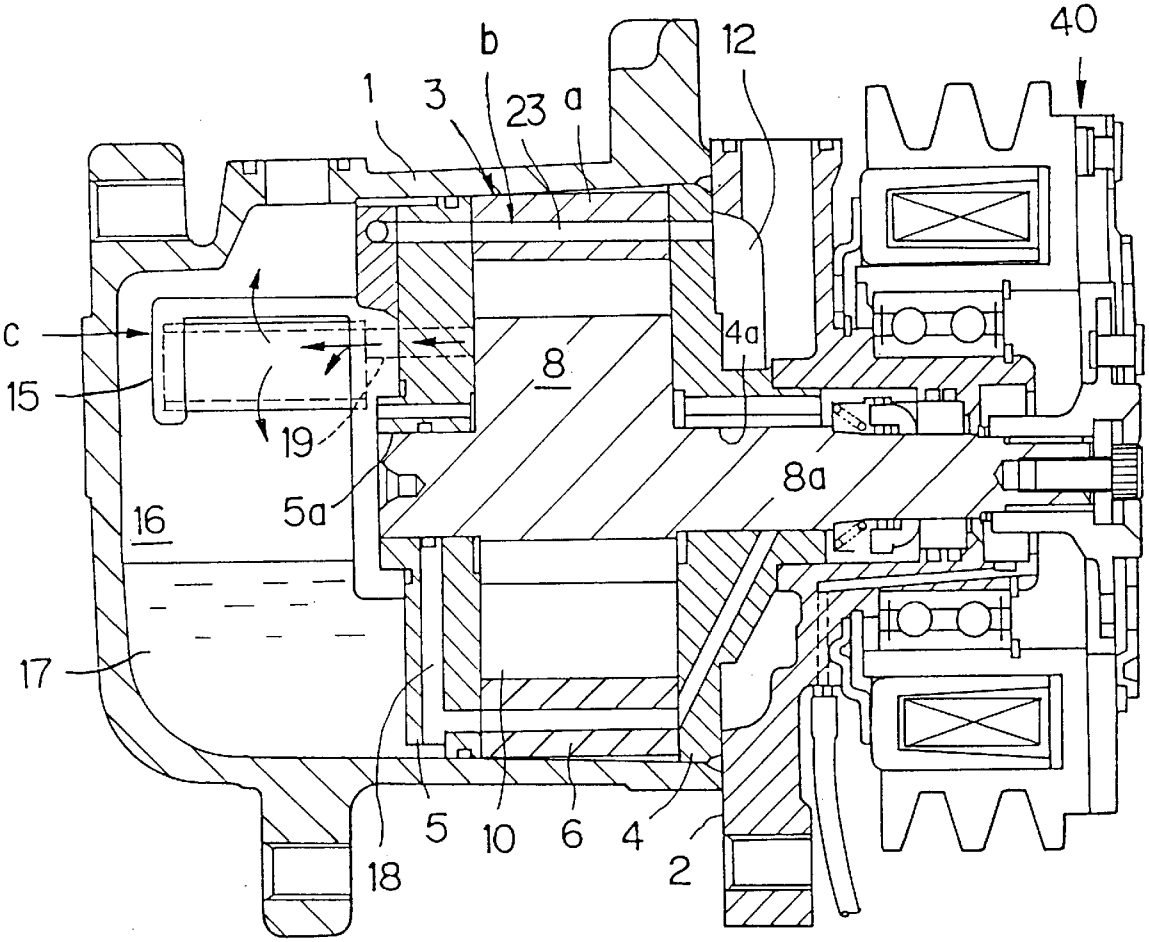
FIG. 5 is a sectional view illustrating another embodiment of the present invention.

FIG. 5 illustrates another embodiment of the present invention. Since the basic construction of the gas compressor illustrated in this figure is the same as that in the above-mentioned embodiment, the same components as those therein are denoted by the same reference numerals and a detailed description thereof is omitted.

The gas compressor illustrated in the figure is provided with a communication passage 23 as means (pressure difference eliminating means (b)) for, when the compression operation of the main body 3 of the compressor is stopped, eliminating the high/low pressure difference between the suction chamber 12 and the discharge chamber 16.

The communication passage 23 has one end open to the suction chamber 12 and the other end open to the discharge chamber 16 and is provided in such a way as to communicate from the suction chamber 12 to the discharge chamber 16 through the front-side block 4, cylinder and rear-side block 5.

Figure 6:
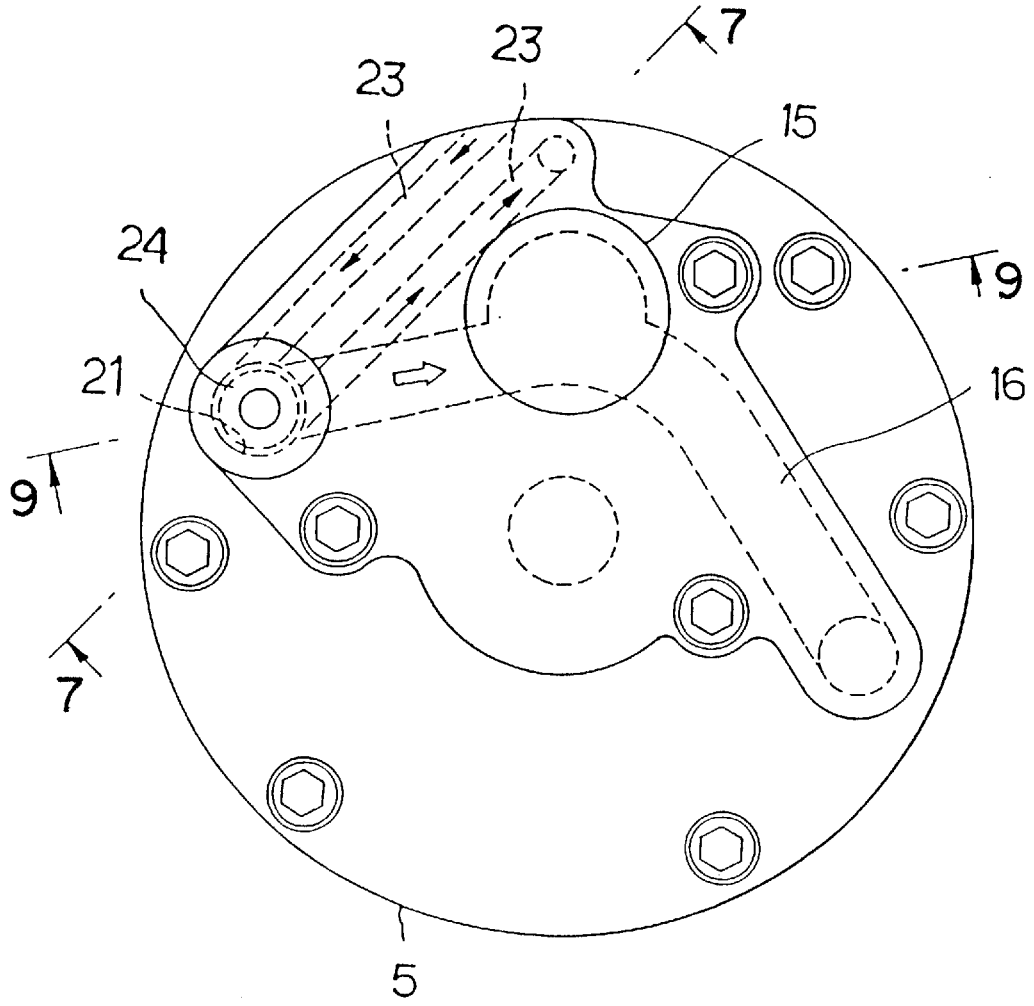
FIG. 6 is a view taken from the direction of an arrow C illustrated in FIG. 5.
Figure 7:
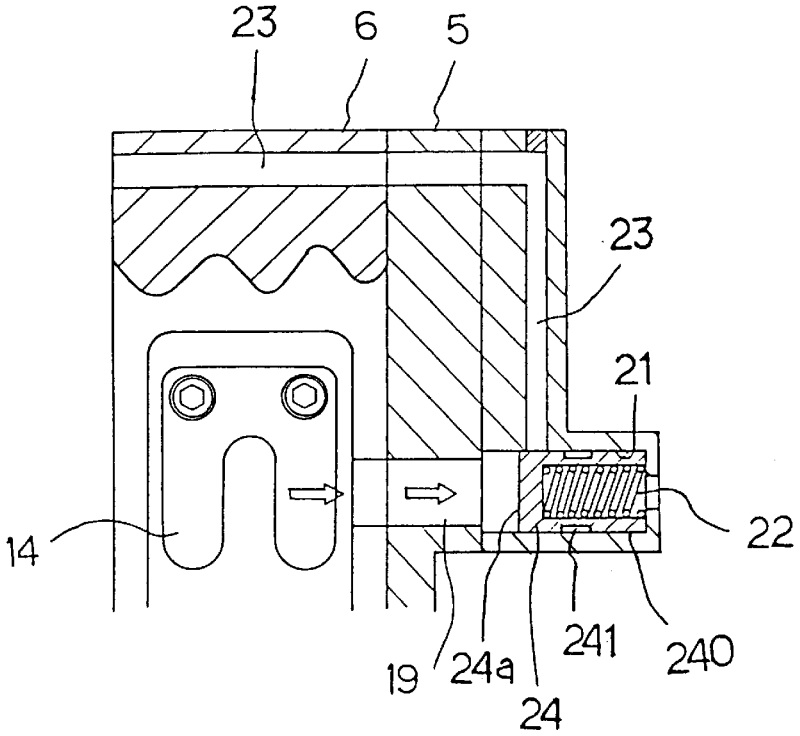
FIG. 7 is a sectional view taken along the line 7—7 of FIG. 6 (when in operation)

As illustrated in FIG. 6, a communication passage opening/closing valve element 24 is provided midway in the communication passage 23 and this valve element 24 is disposed in the vicinity of the discharge valve 14 on the rear-side block 5 side (refer to FIG. 7).

Figure 8:
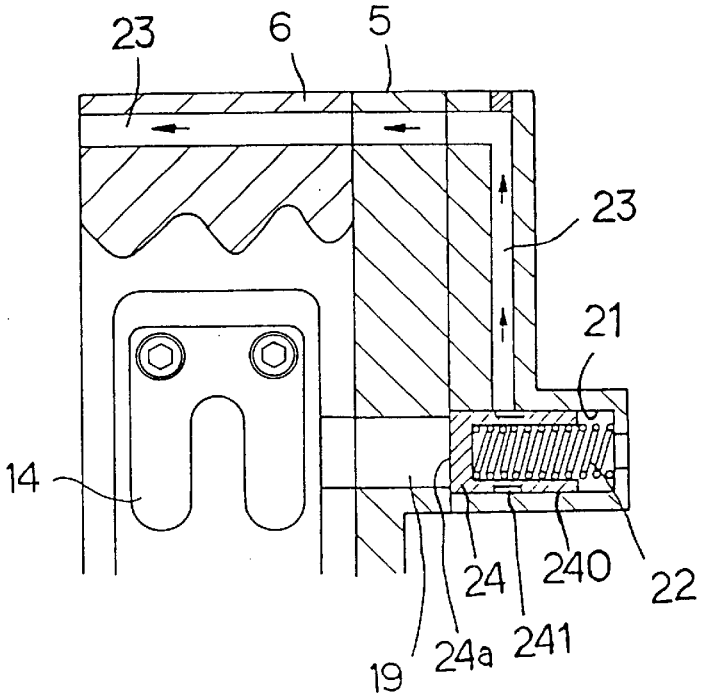
FIG. 8 is a sectional view taken along the line 7—7 of FIG. 6 (when not in operation)
Figure 9:
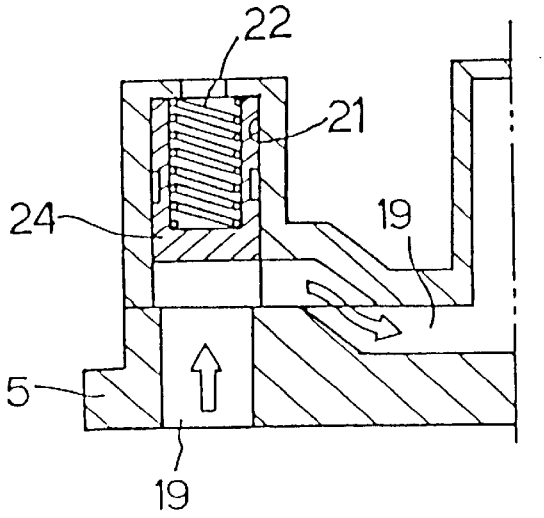
FIG. 9 is a sectional view taken along the line 9—9 of FIG. 6.

As illustrated in FIGS. 7 and 8, the valve element 24 is slidably disposed within the valve chest 21 that is so provided as to intersect the communication passage 23 and a trunk portion 240 of the valve element has a constricted portion 241 formed in a part thereof.

When the valve element 24 is slid and the constricted portion 241 of the trunk portion 240 thereof intersects or positionally coincides with the communication passage 23, this communication passage 23 is opened. When the constricted portion 241 gets off from this position of coincidence, the communication passage 23 is closed.

The end face (pressure receiving surface) 24*a* of the valve element 24 is so provided as to face or confront an open end of the discharge communication passage 19 (refer to FIG. 9) that connects the discharge valve 14 and the discharge chamber 16 and as to cause the high pressure refrigerant gas at a time immediately after having been discharged from the discharge valve 145 to act directly thereon as a discharged jet flow. By the dynamic pressure of the discharged jet flow, the valve element 24 is urged toward a position where it closes the communication passage 23 (refer to FIG. 7)

Within the valve element 24 the spring 22 is disposed as urging means and, by the force of this spring 22, the valve element 24 is urged toward a position where it opens the communication passage 23 (refer to FIG. 8).

When the discharged jet flow of gas acts on the end face 24*a* of the valve element 24, the valve element 24 is slid against the force of the spring 22 by the dynamic pressure thereof, with the result that the position of the constricted portion 241 of the trunk portion 240 of the valve element in coincidence with the communication passage 23 gets off from the position that corresponds thereto. As a result, the communication passage 23 is closed.

When the discharged jet flow with respect to the end face 24*a* of the valve element is stopped, the valve element 24 is slid by the force of the spring 22 whereby the constricted portion 241 of the trunk portion 240 of the valve element and the communication passage 23 positionally coincide with each other, with the result that the communication passage 23 is opened.

That is, when the main body 3 of the compressor starts to make its compression operation and as a result the high pressure refrigerant gas starts to be discharged, the communication passage opening/closing valve element 24 is slid interlockingly with the compression starting operation and, during a time period from immediately after the start of the compression to the stoppage of the compression, closes the communication passage 23. Also, when the main body 3 of the compressor stops its compression and as a result the high pressure refrigerant gas ceases to be discharged, the communication passage opening/closing valve element is slid interlockingly with the compression stopping operation and, during a time period from immediately after the stoppage of the compression operation to the start thereof, opens the communication passage 23.

Next, the operation of the above-constructed gas compressor will be explained with reference to FIGS. 5 to 9.

According to this gas compressor, when the operation is started, the high pressure refrigerant gas that has been compressed by the main body 3 of the compressor immediately thereafter acts directly on the end face 24*a* of the volume element 24 from the discharge valve 14. As a result, the valve element 24 is slid against the force of the spring 22, whereby the communication passage 23 is closed as illustrated in FIG. 7.

The high pressure refrigerant gas that has acted on the end face 24*a* is thereafter discharged into the discharge chamber 16 through the discharge communication passage 19, oil separator 15, etc. At this time, the oil separator 15 separates the oil portion from the high pressure refrigerant gas and the thus separated oil portion pools at the bottom of the discharge chamber 16, whereby the oil pool 17 for the lubricating oil is formed. Also, the lubricating oil in the oil pool 17 is forcedly supplied to the sliding portions such as the F bearing 4*a*, R bearing 5*a*, etc. through the oil passage 18 due to the high/low pressure difference between the suction chamber 12 and the discharge chamber 16. This embodiment is the same as the above-mentioned embodiment in this respect (refer to FIGS. 4 and 5).

When the operation of the gas compressor is stopped with the result that the rotation of the rooter 8 is stopped, the discharged jet flow of the high pressure refrigerant gas from the main body 3 of the compressor 3 to the end face 24*a* of the valve element is stopped. At this time, the valve element 24 is slid by the force of the spring 22 and returns to its original position, with the result that the communication passage 23 is opened.

When the communication passage 23 is opened as mentioned above, the high pressure refrigerant gas which remains to exist in the discharge chamber 16 is released to the suction chamber 12 side through the communication passage 23, whereby the high/low pressure difference between the discharge chamber 16 and the suction chamber 12 is promptly zeroed. As a result, the pressure of the discharge chamber 16 and that of the suction chamber 12 are equalized with each other.

That is, after the compression operation of the main body 3 of the compressor has been stopped, the communication passage 23 is opened immediately thereafter, whereby the high/low pressure difference between the discharge chamber 16 and the suction chamber 12 is forcedly eliminated. As a result of this, the lubricating oil is prevented from being supplied due to such high/low pressure difference from the oil pool 17 to the suction chamber 12 and compression chamber 11 side through the oil passage 18 and sliding portions (F bearing 4*a*, R bearing 5*a*, etc.), whereby the flow of the lubricating oil into the suction chamber 12 and compression chamber 11 is prevented. Accordingly, the unnecessary lubricating oil which when restarting the compression operation is sucked from the suction chamber 12 to the main body 3 side of the compressor and the unnecessary lubricating oil which is within the compression chamber 11 are decreased to the largest possible extent.

The gas compressor according to this embodiment is constructed such that when the compression operation of the main body 3 of the compressor 3 is stopped, the high pressure refrigerant gas that remains to exist in the discharge chamber 16 is released into the suction chamber 12 by the pressure difference eliminating means (b) that is constituted by the communication passage 23 and communication passage opening/closing valve element 24 to thereby make zero the high/low pressure difference between the discharge chamber 16 and the suction chamber or compression chamber 11. For this reason, immediately after the stoppage of the compression operation, the pressure of the discharge chamber 16 and that of the suction chamber 12 or compression chamber 11 become equalized with each other, with the result that the flow of the lubricating oil into the suction chamber 12 and compression chamber 11 side due to such high/low pressure difference is prevented. Accordingly, in this embodiment also, as in the case of the above-mentioned embodiment, the unnecessary lubricating oil which when restarting the compression operation is sucked as is in a liquid state from the suction chamber 12 to the main body 3 side of the compressor and the unnecessary lubricating oil which is within the compression chamber 11 are decreased to the largest possible extent. As a result, no oil compression occurs in the main body 3 of the compressor at the starting time, and the restarting of the compression operation with a small starting torque, the decrease in the shock at the starting time that results from the oil compression, etc. can be achieved.

Figure 10:
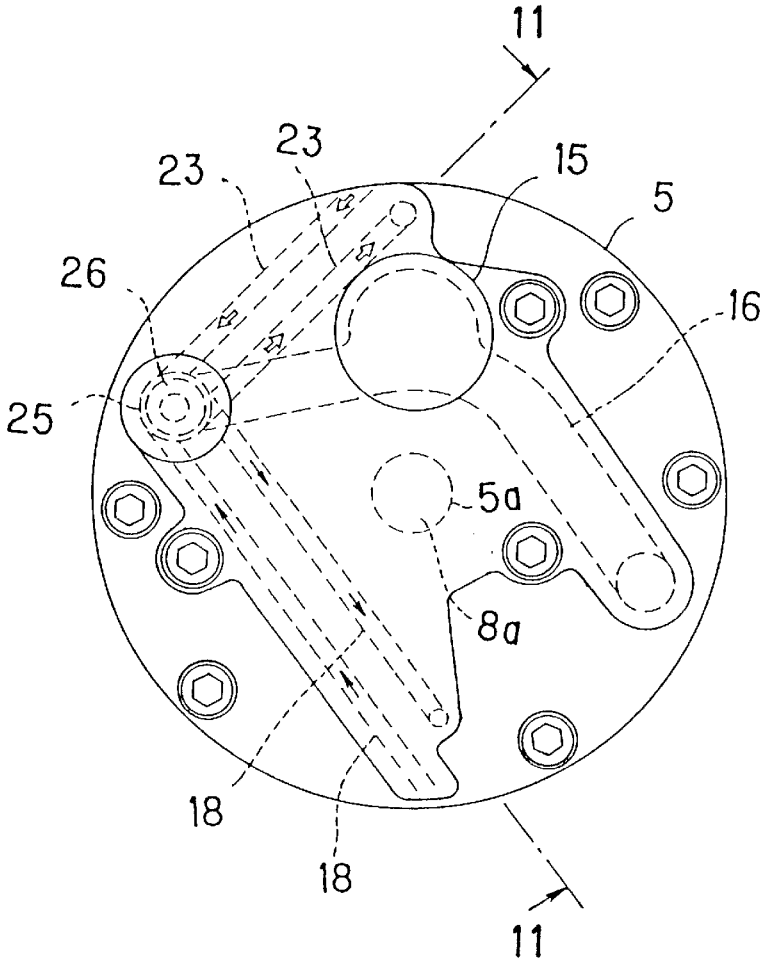
FIG. 10 is a sectional view illustrating another embodiment of the present invention.

It is to be noted that although the gas compressor according to each of the above-mentioned embodiments is of the type equipped with either one of the oil passage opening/closing means (a) and the pressure difference eliminating means (b), from the standpoint of reliably preventing the oil compression in the main body 3 of the compressor at the starting time and the occurrence of the resulting inconveniences (the increase in the starting torque, the increase in the shock occurring at the starting time, etc.), it is also possible to provide the gas compressor with both the oil passage opening/closing means (a) and the pressure difference eliminating means (b). In this case, although the oil passage opening/closing means (a) and the pressure difference eliminating means (b) may be provided individually independently, it is also possible to construct both means into a single unified structure as illustrated in FIG. 10, namely to construct both means (a) and (b) by the communication passage 23, two-passage communication valve chest 25 and two-passage dual purpose valve element 26.

At this time, since a concrete structure of the communication passage 23 such as a structure wherein the communication passage 23 is opened at one end to the suction chamber 12 and opened at the other end to the discharge chamber 16 is the same as in the case of the above-mentioned embodiments, a detailed explanation thereof is omitted here.

The two-passage communication valve chest 25 is provided so as to intersect each of the communication passage 23 and oil passage 18, whereby the two-passage dual purpose valve element 26 is slidably disposed within the two-passage communication valve chest 25.

Figure 11:
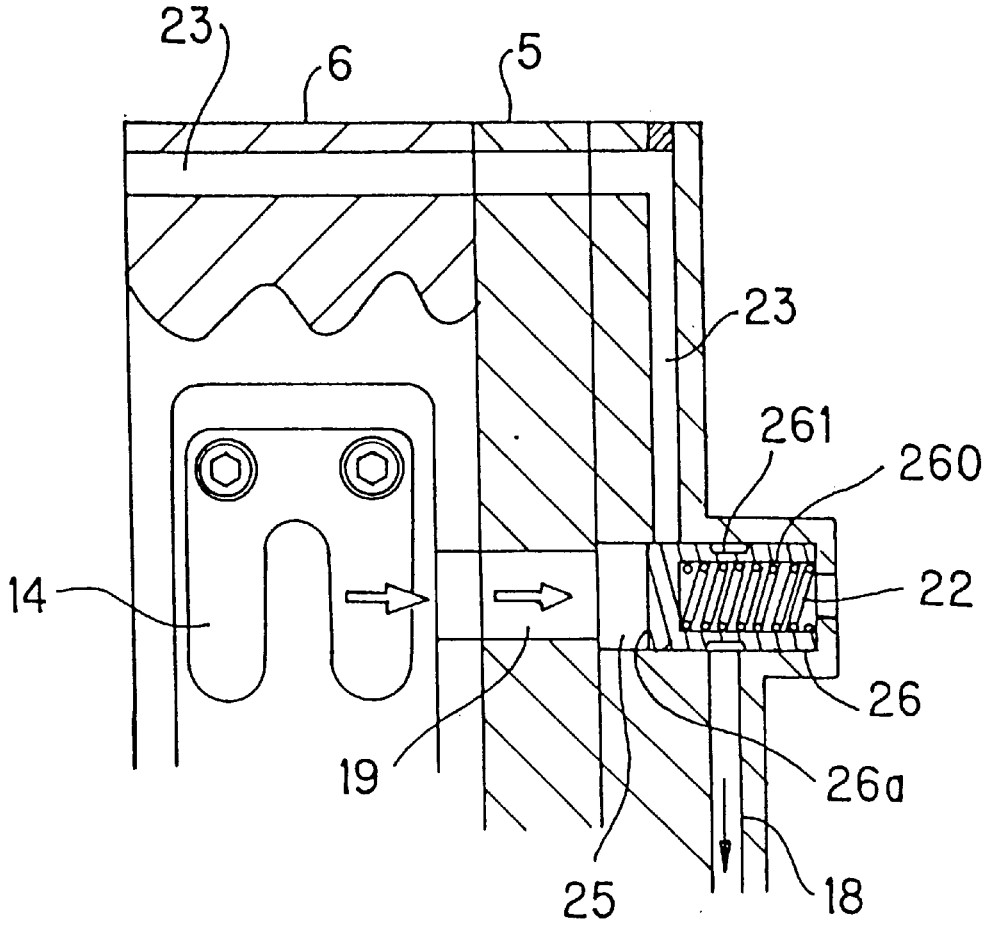
FIG. 11 is a sectional view taken along the line 11—11 of FIG. 10 (when in operation)
Figure 12:
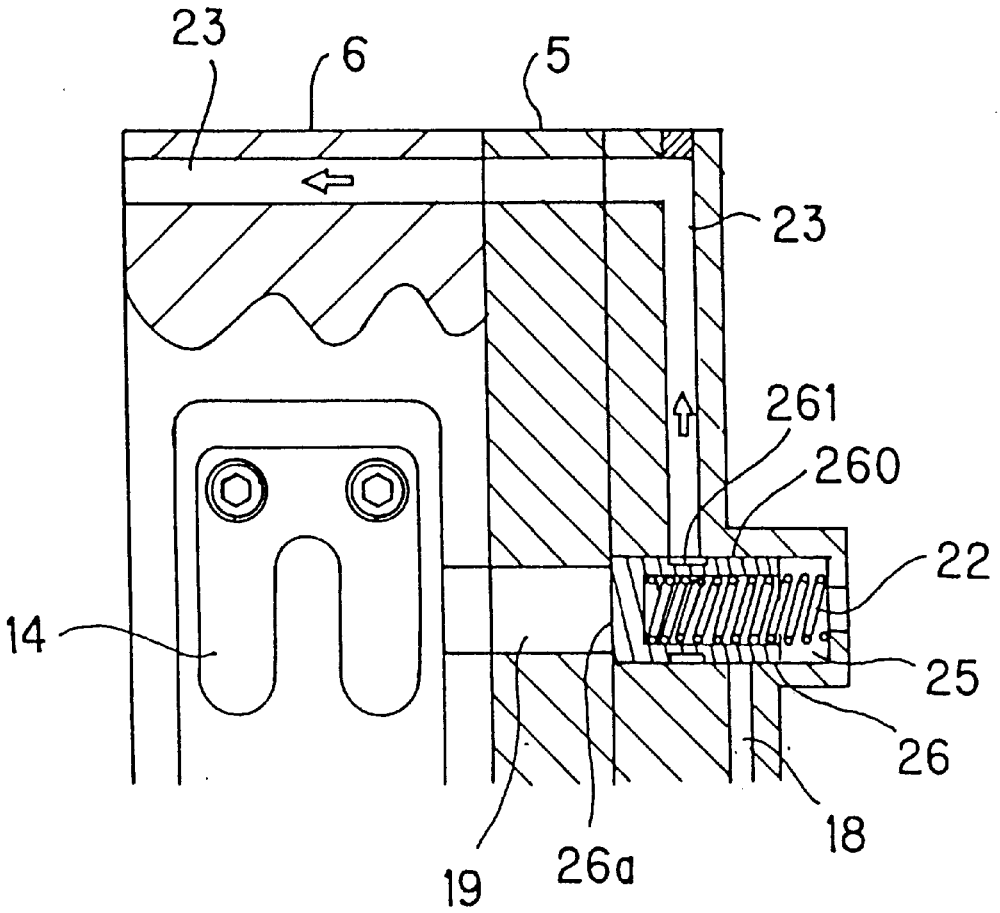
FIG. 12 is a sectional view taken along the line 11—11 of FIG. 10 (when not in operation)

As illustrated in FIGS. 11 and 12, the two-passage dual purpose valve element 26 has the constricted portion 261 formed in the trunk portion 260 of its valve element.

When the two-passage dual purpose valve element 26 slides and as a result the constricted portion 261 of the trunk portion 260 of the valve element arrives at a position in which it coincides with the oil passage 18, this oil passage 18 communicates through the contracted portion 261, namely is opened, while, on the other hand, the communication passage 23 is blocked by the trunk portion 260 and closed (refer to FIG. 11).

On the other hand, when the two-passage dual purpose valve element 26 slides and as a result the constricted portion 261 of the trunk portion 260 of the valve element arrives at a position in which it coincides with the communication passage 23, the communication passage 23 communicates through the constricted portion 261, namely is opened, while, on the other hand, the oil passage 18 is blocked by the trunk portion 260 of the valve element and closed (refer to FIG. 12).

The end face (pressure receiving surface) 26*a* of the two-passage dual purpose valve element 26 is provided so as to face an open end of the discharge communication passage 19 that connects the discharge valve 14 and the valve chamber 16 and as to cause the high pressure refrigerant gas at a time immediately after having been discharged from the discharge valve 14 to act directly thereon as a discharged jet flow. By the dynamic pressure of this discharged jet flow, the two-passage dual purpose valve element 26 is urged toward a position where it closes the communication passage 23 and opens the oil passage 18 (refer to FIG. 11).

Within the two-passage dual purpose valve element 26 the spring 22 is disposed as urging means and, by the force of this spring 22, the two-passage dual purpose valve element 26 is urged toward a position where it opens the communication passage 23 and closes the oil passage 18 (refer to FIG. 12).

When the discharged jet flow acts on the end face 26*a* of the two-passage dual purpose valve element 26, the two-passage dual purpose valve element 26 is slid against the force of the spring 22 by the dynamic pressure of the jet flow, whereby the position of the constricted portion 261 of the trunk portion 260 of the valve element in coincidence with the communication passage 23 gets off from the position thereof. As a result, the communication passage 23 is closed and at this time the constricted portion 261 of the trunk portion 260 of the valve element arrives at a position in which it coincides with the oil passage 18, with the result that the oil passage 18 is opened.

Also, when the discharged jet flow with respect to the end face 26*a* of the valve element is stopped, the two-passage dual purpose valve element 26 is slid by the force of the spring 22, whereby the position of the constricted portion 261 of the trunk portion 260 thereof in coincidence with the oil passage 18 gets off from the position thereof, with the result that the oil passage 18 is closed. Also, at this time, the constricted portion 261 of the trunk portion 260 of the valve element arrives at a position in which it coincides with the communication passage 23, whereby the communication passage 23 is opened.

That is, when the main body 3 of the compressor starts to make compression and as a result the high pressure refrigerant gas starts to be discharged and jetted, the two-passage dual purpose valve element 25 is slid interlockingly with this compression starting operation. During a time period from immediately after the start of the compression operation to the stoppage of the compression, the two-passage dual purpose valve element 25 opens the oil passage 18 and closes the communication passage 23. Also, when the main body 3 of the compressor stops its compression and as a result the high pressure refrigerant gas ceases to be discharged, the two-passage dual purpose valve element 25 is slid interlockingly with the compression stopping operation. During a time period from immediately after the stop of the compression operation to the start of the compression operation, the two-passage dual purpose valve element 25 closes the oil passage 18 and opens the communication passage 23.

In the case where the gas compressor is provided with the oil passage opening/closing means (a) and pressure difference eliminating means (b) in a form wherein both means (a) and (b) are constructed into a single unified structure, and where although both means are not constructed into one unified structure the gas compressor is provided with both means, when the compression operation has been stopped, the oil passage 18 becomes closed interlockingly therewith. Simultaneously, the high pressure refrigerant gas that remains to exist in the discharge chamber 16 is released through the communication passage 23 into the suction chamber 12. As a result, the high/low pressure difference between the discharge chamber 16 and the suction chamber 12 or compression chamber 11 is eliminated. For this reason, simultaneously with the stoppage of the compression operation, the flow of the lubricating oil to the suction chamber 12 and compression chamber 11 side due to such high/low pressure difference can be prevented by the closure of the oil passage 18 and the elimination of the high/low pressure difference being simultaneously executed. As a result, the unnecessary lubricating oil which, when restarting the compression operation, is sucked from the suction chamber 12 to the main body 3 side of the compressor as is in a liquid state as well as the unnecessary lubricating oil that is within the compression chamber is decreased, with the result that the oil compression at the restarting time and the occurrence of the resulting inconveniences (the increase in the starting torque, the increase in the shock at the starting time, etc.) are reliably prevented.

Figure 13A:
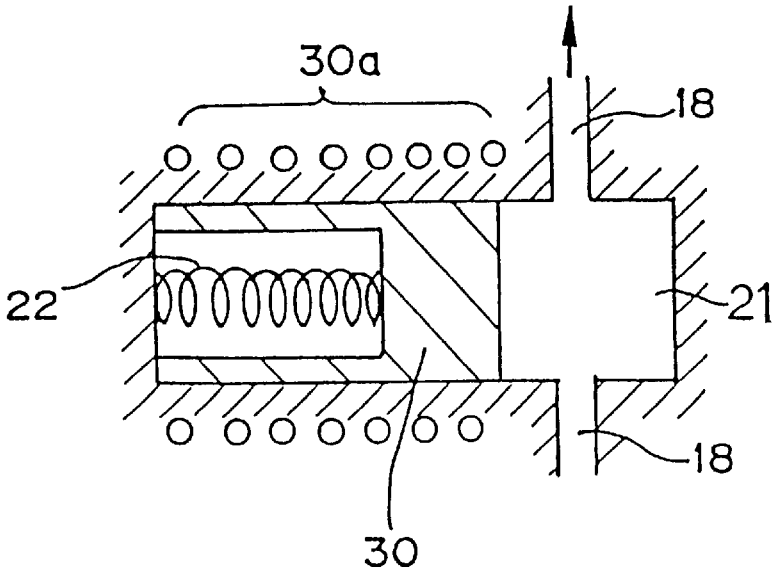
FIGS. 13(*a*) and 13(*b*) are sectional views illustrating another embodiment of the present invention.
Figure 13B:
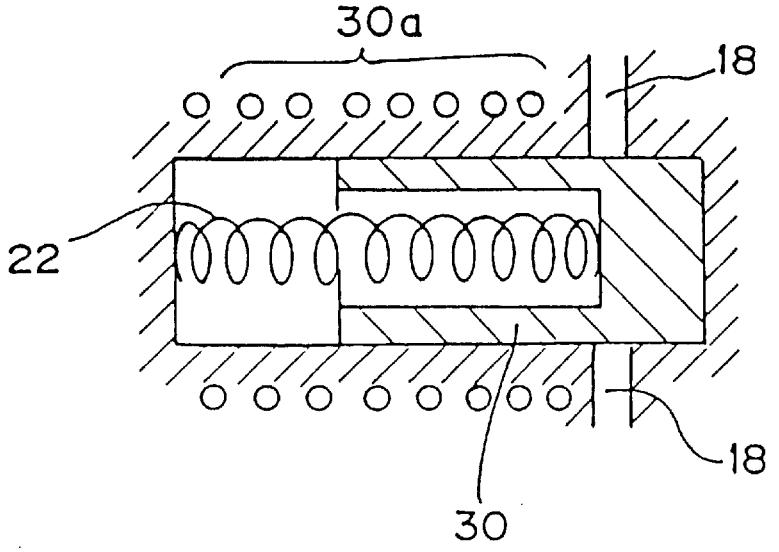

Regarding the oil passage opening/closing means (a), an electromagnetic valve 30 for use in the oil passage such as that illustrated in FIG. 13 can also be applied in place of the oil passage opening/closing valve element 20.

The oil passage electromagnetic valve 30 illustrated in this figure is constructed so as to open and close the oil passage 18 interlockingly with the ON/OFF operations of an electromagnetic clutch 40 (refer to FIG. 5).

The electromagnetic clutch 40 transmits through its ON operation a power (power needed for rotation of the rotor 8) needed for performance of the compression operation from a power source (not illustrated), such as an engine, to the main body 3 of the compressor and, when performing its OFF operation, interrupts transmission of the power to the main body 3 side of the compressor.

The oil passage electromagnetic valve 30 has a coil 30*a* on its outer periphery and it is arranged for a clutch current to flow into the coil 30*a* according to the ON/OFF operations of the electromagnetic clutch 40.

As illustrated in FIG. 13(*a*), when the clutch current flows in the coil 30*a* through the ON operation of the electromagnetic clutch 40, by the resulting magnetic force the electromagnetic valve 30 is slid against the force of the spring 22, with the result that the electromagnetic valve 30 gets off from the position of intersection thereof with the oil passage 18. As a result, the oil passage 18 is opened.

Also, as illustrated in FIG. 13(*b*), when supply of the clutch current to the coil 30*a* is stopped through the OFF operation of the electromagnetic clutch 40, the electromagnetic valve 30 is slid by the force of the spring 22 and thus returns to its original position. As a result, the electromagnetic valve 30 and the oil passage 18 intersect each other, whereby the oil passage 18 is blocked by the peripheral surface of the trunk portion of the valve 30 and is closed.

Since the above-mentioned opening and closing of the oil passage 18 by the oil passage electromagnetic valve 30 are performed in the same way as in the case of using the oil passage opening/closing valve element 20, with the use of the oil passage electromagnetic valve 30 there is also obtained the same effect as is obtained with the use of the oil passage opening/closing valve element 20.

Figure 14A:
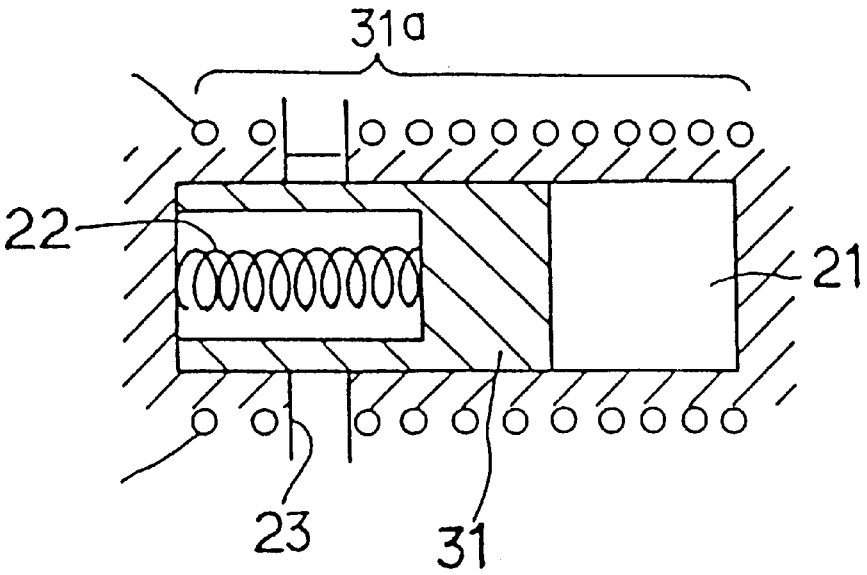
FIGS. 14(*a*) and 14(*b*) are sectional views illustrating another embodiment of the present invention.
Figure 14B:
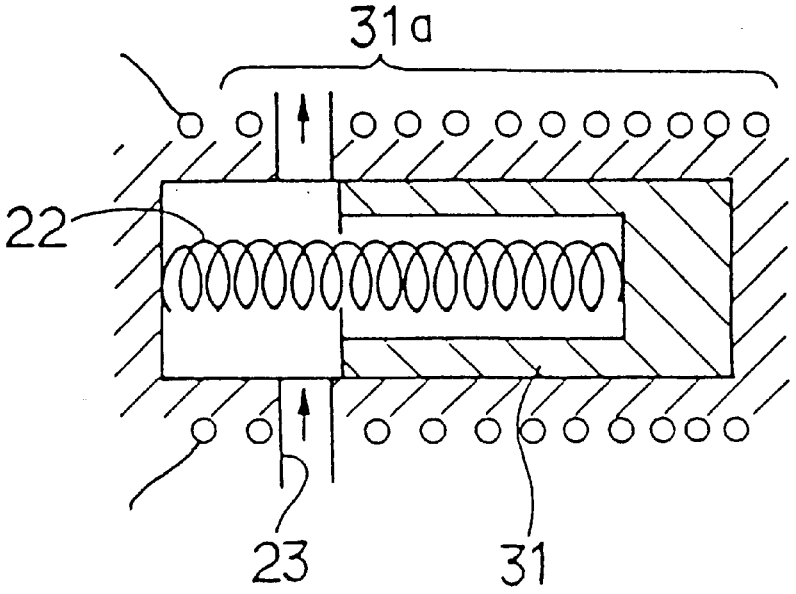

Regarding the pressure difference eliminating means (b), a communication passage electromagnetic valve 31 can also be applied in place of the communication passage opening/closing valve element 24 as illustrated in FIG. 14.

The communication passage electromagnetic valve 31 illustrated in this figure is constructed so as to open and close the communication passage 23 interlockingly with the ON and OFF operations of the electromagnetic clutch 40 (refer to FIG. 5).

The concrete construction of the electromagnetic clutch 40, that is, the construction thereof that the electromagnetic clutch 40 transmits through its ON operation a power (power needed for rotation of the rotor 8) needed for performance of the compression operation from a power source (not illustrated) such as an engine to the main body 3 of the compressor and, when performing its OFF operation, interrupts transmission of the power to the main body 3 side of the compressor, is the same as in the above-mentioned embodiment.

The communication passage electromagnetic valve 31 has a coil 31*a* on its outer periphery and is arranged for a clutch current to flow into the coil 31*a* according to the ON/OFF operations of the electromagnetic clutch 40.

As illustrated in FIG. 14(*a*), when the clutch current flows in the coil 31*a* through the ON operation of the electromagnetic clutch 40, by the resulting magnetic force the electromagnetic valve 31 is slid against the force of the spring 22, with the result that the electromagnetic valve 31 gets off from the position of intersection thereof wit the communication passage 23. As a result, the communication passage 23 is blocked by the peripheral surface of the trunk portion of the electromagnetic valve 31 and becomes closed.

Also, as illustrated in FIG. 14(*b*), when supply of the clutch current to the coil 31*a* is stopped through the OFF operation of the electromagnetic clutch 40, the electromagnetic valve 31 returns to its original position by the force of the spring 22. As a result, the electromagnetic valve 31 gets off from the position of its intersecting with the communication passage 23, whereby the communication passage 23 is opened.

Since the above-mentioned opening and closing of the communication passage 23 by the communication passage electromagnetic valve 31 are performed in the same way as in the case of using the communication passage opening/closing valve element 24, with the use of the communication passage electromagnetic valve 31 there is also obtained the same effect as is obtained with the use of the communication passage opening/closing valve element 24.

Figure 15A:
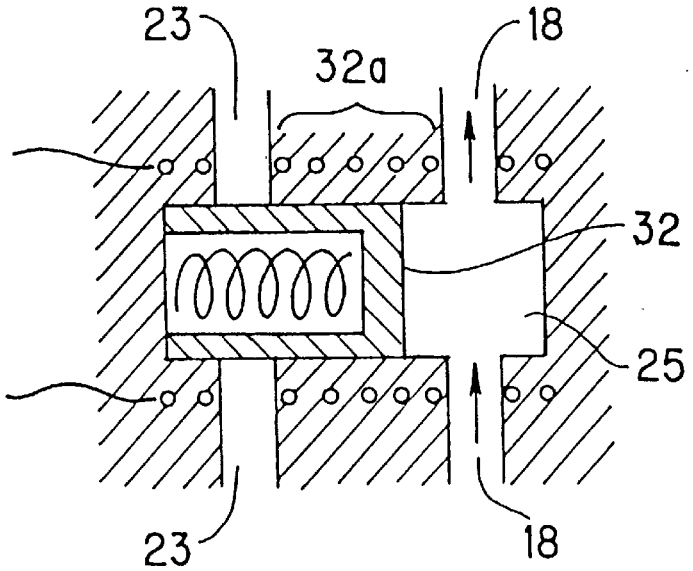
FIGS. 15(*a*) and 15(*b*) are sectional views illustrating another embodiment of the present invention.
Figure 15B:
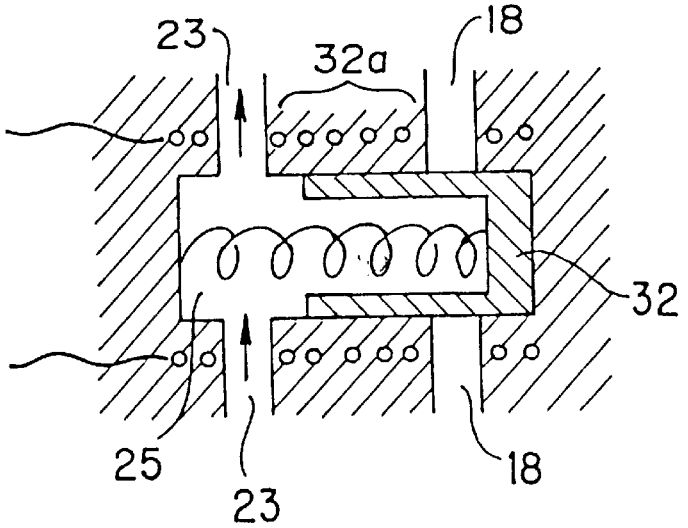

Although in the above-mentioned embodiment the two-passage dual purpose valve element 26 has been used when unifying the oil passage opening/closing means (a) and pressure difference eliminating means (b) into a single structure, it is also possible to use as such a single structure in place of the valve element 26 a two-passage dual purpose electromagnetic valve 32 such as that illustrated in FIG. 15.

The two-passage dual purpose electromagnetic valve 32 illustrated in FIG. 15 is constructed such that the valve 32 opens the oil passage 18 and closes the communication passage 23 interlockingly with the ON operation of the electromagnetic clutch 40 (refer to FIG. 5) while, on the other hand, the valve 32 closes the oil passage 18 and opens the communication passage 23 interlockingly with the OFF operation of the electromagnetic clutch 40.

The concrete construction of the electromagnetic clutch 40 is the same as in the above-mentioned embodiment and therefore a detailed explanation is omitted.

The two-passage dual purpose electromagnetic valve 32 has a coil 32*a* on its outer periphery and it is arranged for a clutch current to flow in the coil 32*a* according to the ON and OFF operation of the electromagnetic clutch 40.

As illustrated in FIG. 15(*a*), when a clutch current flows in the coil 32*a* upon ON operation of the electromagnetic clutch 40, the two-passage dual purpose electromagnetic valve 32 is slid against the force of the spring 22 by the resulting magnetic force. As a result, the electromagnetic valve 32 crosses the communication passage 23, with the result that the communication passage 23 is closed by the electromagnetic valve 32. At this time, the electromagnetic valve 32 does not cross the oil passage 18 and opens the oil passage 18.

Furthermore, as illustrated in FIG. 15(*b*), when supply of the clutch current to the coil 32 is stopped upon OFF operation of the electromagnetic clutch 40, the two-passage dual purpose electromagnetic valve 32 is slid against the force of the spring 22 and returns to its original position. As a result, the electromagnetic valve 32 and the oil passage 18 cross each other, whereby the oil passage 18 is closed by the electromagnetic valve 32. At this time, the electromagnetic valve does not cross the communication passage 23 and opens the communication passage 23.

Since the opening and closing of the oil passage 18 and communication passage 23 by the above-mentioned two-passage dual purpose electromagnetic valve 32 are performed in the same way as are when using the above-mentioned two passage dual purpose valve element 26, the same effect that is attainable with the use of the two-passage dual purpose valve element 26 is obtained also with the use of the two-passage dual purpose electromagnetic valve 32.

When using the oil passage electromagnetic valve 30, communication passage electromagnetic valve 31 and two-passage dual purpose electromagnetic valve 32 as mentioned above, each of the electromagnetic valves 30, 31 and 32 is not operated by the jet flow of discharged high pressure refrigerant gas, as is the oil passage opening/closing valve element 20, but is operated by the clutch current. Therefore, there is no need to cause a jet flow of discharged high pressure refrigerant gas to act on the end face thereof.

It is to be noted that the oil compression occurs due to the oil which has been pooled mainly within the compression chamber whose pressure has been decreased when the compression is out of operation.

Figure 16:
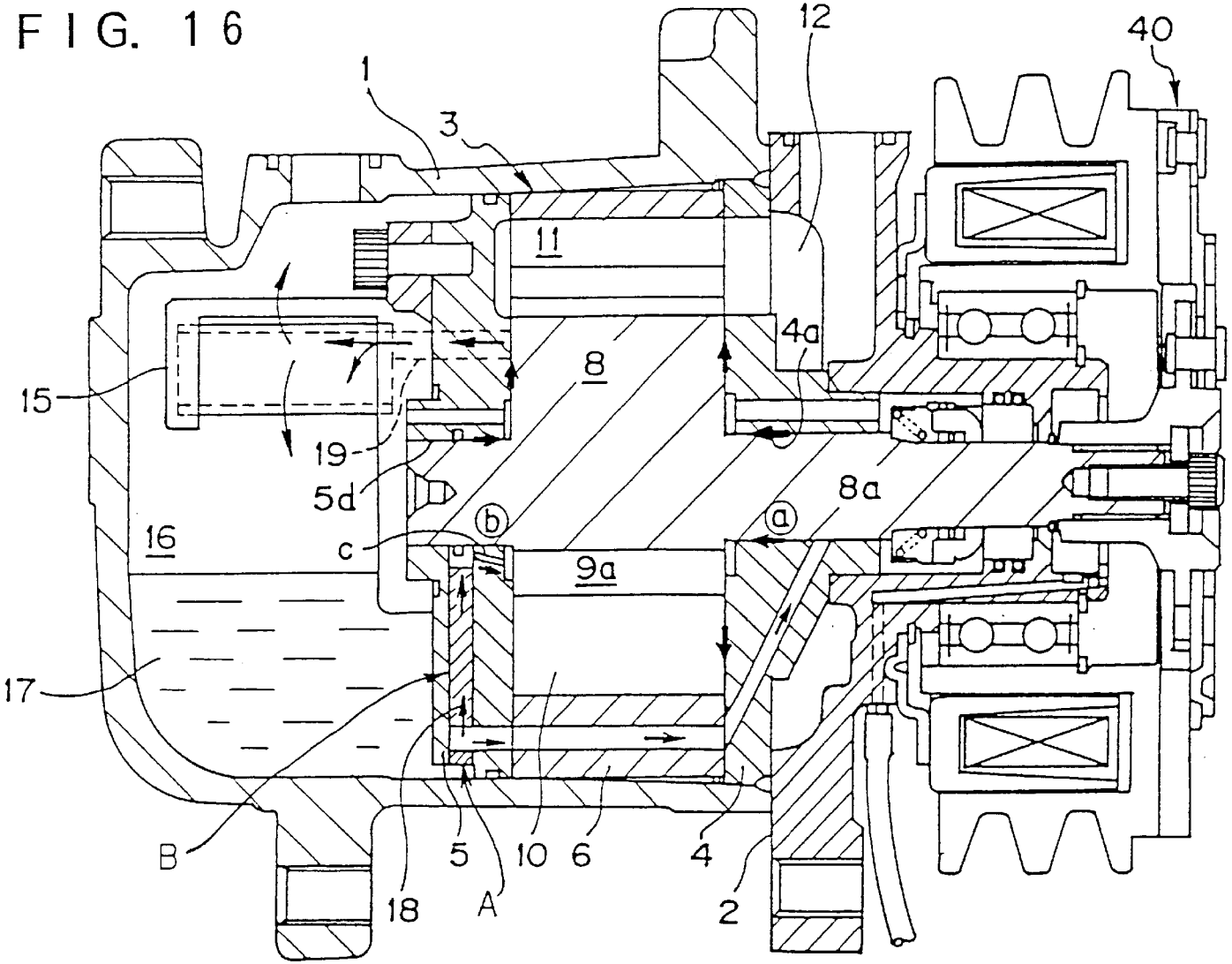
FIG. 16 is a sectional view illustrating another embodiment of the present invention.

As illustrated in FIG. 16, the lubricating oil flows on one hand into a rotor bearing portion (a) of the front-side block side and flows on the other hand into a high pressure supply hole (c) that communicates the oil passage 18 with the vane back pressure chamber 9*a* at the rotor bearing portion (b) of the rear-side block side and in the vicinity thereof. In addition, this lubricating oil is also introduced into the compression chamber 11 by way of the rotor 8, side clearance between the rear-side block and the vanes 10, and vane slit clearance.

The high pressure supply hole (c) is provided for the purpose of increasing the vane back pressure during the compressor operation. The oil flowrate ratio among the rotor bearing potion (a), rotor bearing portion (b) and high pressure supply hole (c) is 1:1:3400 (where it is assumed that the oil flowrate in the rotor bearing portion (a) is 1). As understood, in the high pressure supply hole (c) the oil is the easiest to flow.

Accordingly, if the oil passage opening/closing valve element 20 is installed at a portion (A) which is the inlet portion of the oil passage 18 at which the oil enters thereinto from the oil pool 17, it can completely serve its purpose. However, since even mere closing of only the high pressure supply hole (c) which is high in the oil flowrate can sufficiently serve the purpose, the valve element 20 may be installed at a portion (B) of the oil passage 18 which communicates with the high pressure supply hole (c).

Figure 17A:
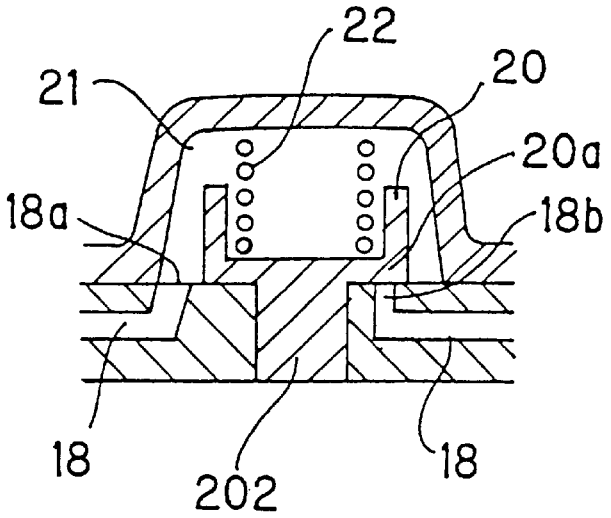
FIGS. 17(*a*) and 17(*b*) are sectional views illustrating another embodiment of the present invention.
Figure 17B:
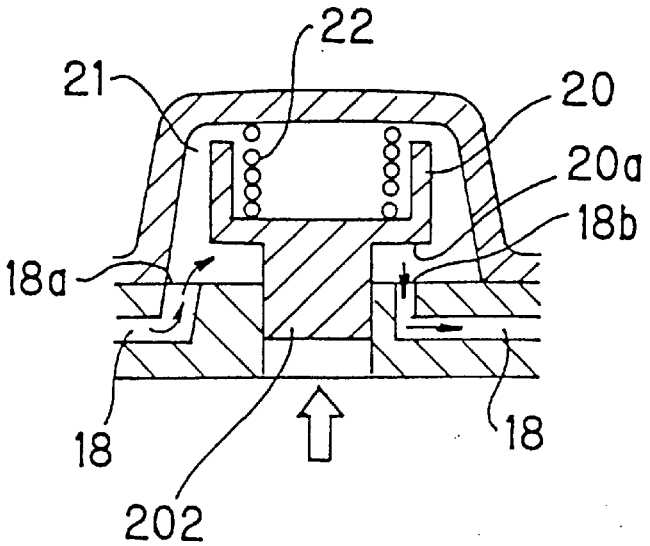
Figure 18:
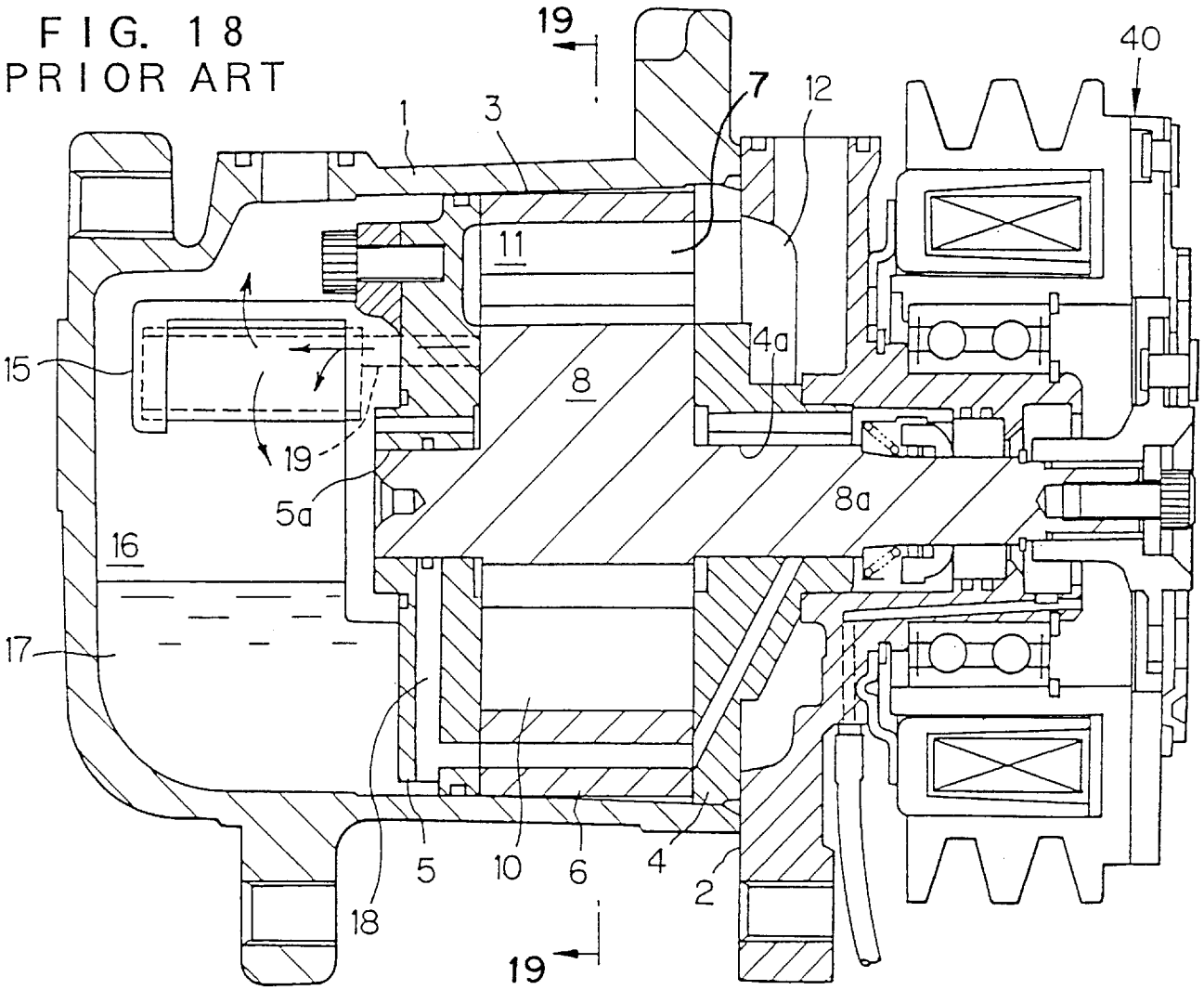
FIG. 18 PRIOR ART
FIG. 18 is a sectional view illustrating a conventional gas compressor.
Figure 19:
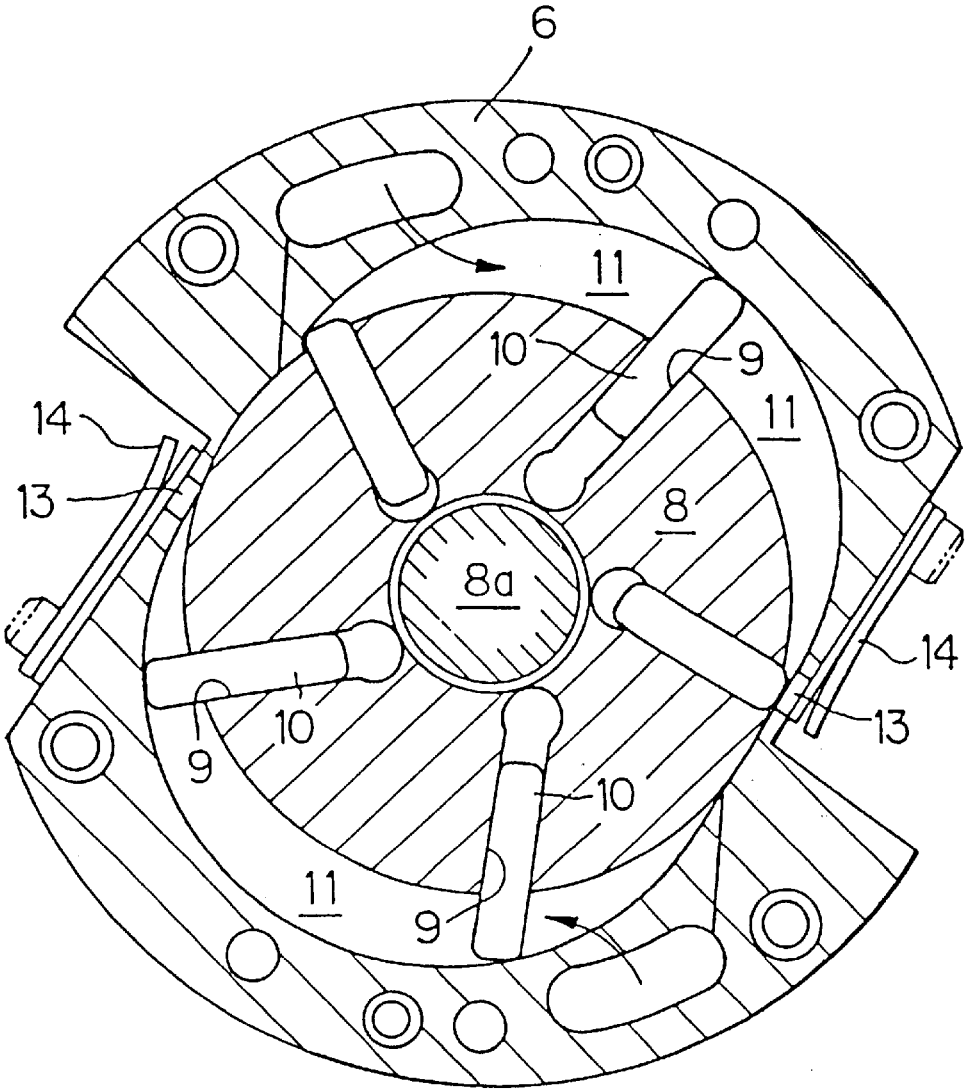
FIG. 19 PRIOR ART
FIG. 19 is a sectional view taken along the line 19—19 of FIG. 18.

Although in the embodiment illustrated in FIG. 2 there has been adopted the oil passage opening/closing means (a) which is constructed such that the oil passage 18 is opened and closed by the trunk portion 200 of the valve element 20, the oil passage opening/closing means (a) may also be arranged to open and close the oil passage 18 by the end face 20*a* of the valve element 20 as illustrated in FIG. 17.

That is, the oil passage opening/closing means (a) illustrated in FIG. 17 has the valve element 20 within a valve chest 21 provided midway in the oil passage 18, and the end face 20*a* of the valve element 20 opposes an inlet/outlet 18*a*, 18*b* of the valve chest 21 with respect to the oil passage 18. The end face 20*a* is formed into a size which enables closure of the outlet 18*b* of the valve chest 21.

A pressure receiving portion 202 is formed on the end face 20*a* of the valve element 20 in such a way as to protrude therefrom. The pressure receiving portion 202 is caused to face the discharge communication passage 19 (refer to FIG. 3) which communicates the discharge valve 14 with the discharge chamber 16, whereby it is arranged to cause the high pressure refrigerant gas which is immediately after having been discharged from the discharge valve 14 to act directly thereon as a discharged jet flow of the gas. That is, it is arranged to cause the discharge jet flow of high pressure refrigerant gas to act on the end face 20*a* of the valve element through the pressure receiving portion 202, with the result that the valve element 20 is urged by the dynamic pressure of such discharged jet flow in such a direction as to cause the end face 20*a* thereof to part away from the outlet 18*b* of the valve chest of the oil passage 18*b* of the valve chest of the oil passage 18 (in such a direction as to make the oil passage 18 open).

Furthermore, within the valve element 20 there is disposed the spring 22 as urging means. By the force of this spring 22, the valve element 20 is urged in such a direction as to cause the end face 20*a* thereof to abut against the outlet 18*b* of the valve chest of the oil passage 18 (in such a direction as to make the oil passage 18 close).

When the discharged jet flow of the gas has acted on the pressure receiving portion 202 of the valve element 20, as illustrated in FIG. 17(*b*), the valve element 20 is caused by the dynamic pressure thereof to slide against the force of the spring 22, whereby the end face 20*a* of the valve element parts away from the outlet 18*b* of the valve chest of the oil passage 18. As a result, the oil passage 18 is opened.

On the other hand, when the discharged jet flow that has acted on the pressure receiving portion 202 is stopped, as illustrated in FIG. 17(*a*), the valve element 20 is caused by the force of the spring 22 to slide, whereby the end face 20*a* of the valve element abuts against the outlet 18*b* of the valve chest of the oil passage 18. As a result, substantially simultaneously with the stop of the discharged jet flow, the oil passage 18 is closed.

As mentioned above, in the gas compressor according to the present invention, there is provided the passage opening/closing means which makes the oil passage close interlockingly with the compression stopping operation. For this reason, when the compression operation has been stopped, in even a case where there exists a residual high/low pressure difference between the discharge chamber and suction chamber or compression chamber, there occurs no supply of the lubricating oil from the oil pool to the suction chamber and compression chamber side through the oil passage and sliding portions due to such high/low pressure difference. Therefore, it is possible to prevent the flow of the lubricating oil into the suction chamber and compression chamber side during the stoppage of the compression operation. Accordingly, when restarting the compression operation, the unnecessary lubricating oil that is sucked from the suction chamber to the main body side of the compressor as it is in a liquid state as well as the unnecessary lubricating oil within the compression chamber decreases to the largest possible extent. As a result, the oil compression at the starting time ceases to occur, whereby restart of the compression operation with a small starting torque, reduction in the shock at the starting time that results from the oil compression, etc. can be achieved.

Further, according to the present invention, when the compression operation of the main body of the compressor has been stopped, the high pressure refrigerant gas that remains to exist in the discharge chamber into the suction chamber is released by the pressure difference eliminating means, thereby zeroing the high/low pressure difference between the discharge chamber and the suction or compression chamber. For this reason, immediately after the stoppage of the compression operation, the pressure of the discharge chamber and the pressure of the suction or compression chamber become equalized with each other, with the result that the flow of the lubricating oil to the suction and compression chamber side due to such high/low pressure difference is prevented. Accordingly, as in the above-mentioned case, when restarting the compression operation, the unnecessary lubricating oil that is sucked from the suction chamber to the main body side of the compressor as it is in a liquid state as well as the unnecessary lubricating oil within the compression chamber decreases to the largest possible extent. As a result, the oil compression at the starting time ceases to occur, whereby restart of the compression operation with a small starting torque, reduction in the shock at the starting time that results from the oil compression, etc. can be achieved.

Furthermore, according to the present invention, there are provided the two means which are the passage opening/closing means and the pressure difference eliminating means. By this construction, when the compression operation has been stopped, the oil passage is closed interlockingly with the stoppage and the high pressure refrigerant gas that remains to exist within the discharge chamber is simultaneously released into the suction chamber, thereby zeroing the high/low pressure difference between the discharge chamber and the suction chamber compression chamber. For this reason, simultaneously with the stoppage of the compression operation, the flow of the lubricating oil to the suction and compression chamber side due to such high/low pressure difference is prevented simultaneously both by the closure of the oil passage and by the elimination of the high/low pressure difference. Accordingly, when restarting the compression operation, the unnecessary lubricating oil that is sucked from the suction chamber to the main body side of the compressor as it is in a liquid state as well as the unnecessary lubricating oil within the compression chamber decreases more. As a result, the oil compression at the starting time and the occurrence of the resulting inconveniences (the increase in the starting torque, increase in the shock at the starting time, etc.) can be reliably prevented.

What is claimed is:

1. A gas compressor comprising:

a suction chamber having a low pressure refrigerant gas introduced thereinto;

a main body having sliding portions and a compression chamber for drawing in the low pressure refrigerant gas introduced into the suction chamber and undergoing a compression operation to compress the low pressure refrigerant gas to a high pressure refrigerant gas;

a discharge chamber into which the high pressure refrigerant gas from the main body is discharged;

an oil pool having lubricating oil on which the pressure of the discharge chamber acts;

an oil passage having an inlet port opening into the oil pool and an outlet port opening into the sliding portions of the main body of the compressor, the lubricating oil from the oil pool being supplied to the sliding portions of the main body through the oil passage due to a pressure difference between the discharge chamber and one of the suction chamber and the compression chamber; and pressure difference eliminating means for releasing the high pressure refrigerant gas from the discharge chamber to the suction chamber when the compression operation in the compression chamber of the main body stops to thereby eliminate the pressure difference between the discharge chamber and one of the suction chamber and the compression chamber.

2. A gas compressor as set forth in claim 1, wherein the pressure difference eliminating means comprises:

a communication passage that is opened at one end to the suction chamber and opened at the other end to the discharge chamber;

a valve chest that is so provided as to intersect the communication passage; and a communication passage opening/closing valve element that is slidably disposed within the valve chest and that, after the start of the compression operation of the main body of the compressor, is slid by a discharged jet flow of the high pressure refrigerant gas from the main body of the compressor to thereby close the communication passage and that, after the stoppage of the compression operation, is slid by an urging force of urging means composed of a spring or the like to thereby open the communication passage.

3. A gas compressor as set forth in claim 1, which further comprises an electromagnetic clutch that transmits and interrupts a power needed for performance of the compression operation according to the ON and OFF operations thereof, and in which the pressure difference eliminating means comprises:

a communication passage that is opened at one end to the suction chamber and opened at the other end to the discharge chamber; and a communication passage electromagnetic valve that opens and closes the communication passage according to the ON and OFF operations of the electromagnetic clutch.

4. A gas compressor comprising:

a suction chamber having a low pressure refrigerant gas introduced thereinto;

a main body having sliding portions and a compression chamber for drawing in the low pressure refrigerant gas introduced into the suction chamber and undergoing a compression operation to compress the low pressure refrigerant gas to a high pressure refrigerant gas;

a discharge chamber into which the high pressure refrigerant gas from the main body is discharged;

an oil pool having lubricating oil on which the pressure of the discharge chamber acts;

an oil passage having an inlet port opening into the oil pool and an outlet port opening into the sliding portions of the main body of the compressor, the lubricating oil from the oil pool being supplied to the sliding portions of the main body through the oil passage due to a pressure difference between the discharge chamber and one of the suction chamber and the compression chamber;

oil passage opening/closing means disposed in the oil passage for opening the oil passage at the start of a compression operation in the compression chamber of the main body and closing the oil passage when the compression operation stops; and pressure difference eliminating means for releasing the high pressure refrigerant gas from the discharge chamber to the suction chamber when the compression operation in the compression chamber of the main body stops to thereby eliminate the pressure difference between the discharge chamber and one of the suction chamber and the compression chamber.

5. A gas compressor as set forth in claim 4, wherein the oil passage opening/closing means comprises:

a valve chest provided midway in the oil passage; and an oil passage opening/closing valve element that is slidably disposed within the valve chest and that, after the start of the compression operation of the main body of the compressor, is slid by a discharged jet flow of the high pressure refrigerant gas from the main body of the compressor to thereby open the oil passage and that, after the stoppage of the compression operation, is slid by an urging force of urging means composed of a spring or the like to thereby close the oil passage.

6. A gas compressor as set forth in claim 4, which further comprises an electromagnetic clutch that transmits and interrupts a power needed for performance of the compression operation according to the ON and OFF operations thereof, and in which the oil passage opening/closing means is constituted by an oil passage electromagnetic valve that opens and closes the oil passage according to the ON and OFF operations of the electromagnetic clutch.

7. A gas compressor as set forth in claim 4, wherein the pressure difference eliminating means comprises:

a communication passage that is opened at one end to the suction chamber and opened at the other end to the discharge chamber;

a valve chest that is so provided as to intersect the communication passage; and a communication passage opening/closing valve element that is slidably disposed within the valve chest and that, after the start of the compression operation of the main body of the compressor, is slid by a discharged jet flow of the high pressure refrigerant gas from the main body of the compressor to thereby close the communication passage and that, after the stoppage of the compression operation, is slid by an urging force of urging means composed of a spring or the like to thereby open the communication passage.

8. A gas compressor as set forth in claim 4, which further comprises an electromagnetic clutch that transmits and interrupts a power needed for performance of the compression operation according to the ON and OFF operations thereof, and in which the pressure difference eliminating means comprises:

a communication passage that is opened at one end to the suction chamber and opened at the other end to the discharge chamber; and a communication passage electromagnetic valve that opens and closes the communication passage according to the ON and OFF operations of the electromagnetic clutch.

9. A gas compressor comprising a suction chamber having a low pressure refrigerant gas introduced thereinto;

a main body having sliding portions and a compression chamber for drawing in the low pressure refrigerant gas introduced into the suction chamber and undergoing a compression operation to compress the low pressure refrigerant gas to a high pressure refrigerant gas;

a discharge chamber into which the high pressure refrigerant gas from the main body is discharged;

an oil pool having lubricating oil on which the pressure of the discharge chamber acts;

an oil passage having an inlet port opening into the oil pool and an outlet port opening into the sliding portions of the main body of the compressor, the lubricating oil from the oil pool being supplied to the sliding portions of the main body through the oil passage due to a pressure difference between the discharge chamber and one of the suction chamber and the compression chamber;

oil passage opening/closing means disposed in the oil passage for opening the oil passage at the start of a compression operation in the compression chamber of the main body and closing the oil passage when the compression operation stops; and pressure difference eliminating means for releasing the high pressure refrigerant gas from the discharge chamber to the suction chamber when the compression operation in the compression chamber of the main body stops to thereby eliminate the pressure difference between the discharge chamber and one of the suction chamber and the compression chamber;

wherein a unified means of the oil passage opening/closing means and the pressure difference eliminating means comprises a communication passage opening at one end to the suction chamber and opening at the other end to the discharge chamber;

a two-passage communication valve chest provided to intersect the communication passage and the oil passage; and a two-passage purpose valve element slidably disposed within the two-passage communication valve chest and operative, after the start of the compression operation of the main body of the compressor, to be slid by a discharged jet flow of the high pressure refrigerant gas from the main body of the compressor to thereby open the oil passage and close the communication passage and operative, after the stoppage of the compression operation, to be slid by an urging force of urging means to thereby close the oil passage and open the communication passage.

10. A gas compressor comprising:

a suction chamber having a low pressure refrigerant gas introduced thereinto;

a main body having sliding portions and a compression chamber for drawing in the low pressure refrigerant gas introduced into the suction chamber and undergoing a compression operation to compress the low pressure refrigerant gas to a high pressure refrigerant gas;

a discharge chamber into which the high pressure refrigerant gas from the main body is discharged;

an oil pool having lubricating oil on which the pressure of the discharge chamber acts;

an oil passage having an inlet port opening into the oil pool and an outlet port opening into the sliding portions of the main body of the compressor, the lubricating oil from the oil pool being supplied to the sliding portions of the main body through the oil passage due to a pressure difference between the discharge chamber and one of the suction chamber and the compression chamber;

oil passage opening/closing means disposed in the oil passage for opening the oil passage at the start of a compression operation in the compression chamber of the main body and closing the oil passage when the compression operation stops;

pressure difference eliminating means for releasing the high pressure refrigerant gas from the discharge chamber to the suction chamber when the compression operation in the compression chamber of the main body stops to thereby eliminate the pressure difference between the discharge chamber and one of the suction chamber and the compression chamber; and an electromagnetic clutch for transmitting a power needed for performance of the compression operation according to the ON operation thereof and for interrupting the transmission of power according to the OFF operation thereof; and wherein a unified means of the oil passage opening/closing means and the pressure difference eliminating means comprises a communication passage opening at one end to the suction chamber and opening at the other end to the discharge chamber; and a two-passage purpose electromagnetic valve that opens the oil passage and closes the communication passage according to the ON operation of the electromagnetic clutch and closes the oil passage and opens the communication passage according to the OFF operation of the electromagnetic clutch.

11. A gas compressor comprising:

a first chamber for receiving a low pressure refrigerant gas;

a main body having a second chamber for drawing in the low pressure refrigerant gas from the first chamber and undergoing a compression operation to compress the low pressure refrigerant gas to a high pressure refrigerant gas;

a third chamber for receiving the high pressure refrigerant gas from the second chamber;

a fourth chamber for receiving a lubricating oil, the fourth chamber being subjected to the pressure of the high pressure refrigerant gas from the third chamber;

an oil passage having an inlet port opening into the fourth chamber and an outlet port opening into the main body, the lubricating oil from the fourth chamber being supplied to the main body through the oil passage due to a pressure difference between the third chamber and one of the first chamber and the second chamber; and a pressure difference eliminating device for releasing the high pressure refrigerant gas from the third chamber to the first chamber upon stoppage of the compression operation in the second chamber to thereby eliminate the pressure difference between the third chamber and one of the first chamber and the second chamber.

12. A gas compressor as claimed in claim 11; wherein the pressure difference eliminating device comprises a communication passage having a first end opening into the first chamber and a second end opening into the third chamber, a valve chest intersecting the communication passage, and a valve element slidably disposed within the valve chest for closing the communication passage after the start of the compression operation and opening the communication passage after the stoppage of the compression operation.

13. A gas compressor as claimed in claim 12; wherein the valve element is slid by the high pressure refrigerant gas to close the communication passage; and further comprising a biasing member for applying a biasing force to slide the valve element to open the communication passage.

14. A gas compressor as claimed in claim 11; further comprising an opening/closing device disposed in the oil passage for opening the oil passage after the start of the compression operation and closing the oil passage after stoppage of the compression operation.

15. A gas compressor as claimed in claim 14; wherein the opening/closing device comprises a valve chest disposed midway in the oil passage, and a valve element slidably disposed within the valve chest for opening the oil passage after the start of the compression operation and closing the oil passage after the stoppage of the compression operation.

16. A gas compressor as claimed in claim 15; wherein the valve element is slid by the high pressure refrigerant gas to open the oil passage; and further comprising a biasing member for applying a biasing force to slide the valve element to close the oil passage.

17. A gas compressor as claimed in claim 14; further comprising an electromagnetic clutch for transmitting and interrupting the power needed for performance of the compression operation according to the ON and OFF operations thereof; and wherein the opening/closing device comprises an electromagnetic valve for opening and closing the oil passage according to the ON and OFF operations of the electromagnetic clutch.

18. A gas compressor as claimed in claim 11; further comprising an electromagnetic clutch for transmitting and interrupting the power needed for performance of the compression operation according to the ON and OFF operations thereof; and wherein the pressure difference eliminating device comprises a communication passage having a first end opening into the first chamber and a second end opening into the third chamber, and an electromagnetic valve for opening an closing the communication passage according to the ON and OFF operations of the electromagnetic clutch.

* * * * *